US006608620B1

(12) United States Patent
Suzuki et al.

(10) Patent No.: US 6,608,620 B1
(45) Date of Patent: Aug. 19, 2003

(54) DISPLAY APPARATUS

(75) Inventors: Mutsumi Suzuki, Kodaira (JP); Yoshiyuki Kaneko, Hachioji (JP); Toshiaki Kusunoki, Tokorozawa (JP); Masakazu Sagawa, Inagi (JP)

(73) Assignee: Hitachi, Ltd., Tokyo (JP)

( * ) Notice: Subject to any disclaimer, the term of this patent is extended or adjusted under 35 U.S.C. 154(b) by 236 days.

(21) Appl. No.: 09/658,260

(22) Filed: Sep. 8, 2000

(30) Foreign Application Priority Data

Sep. 10, 1999 (JP) ..... 11-257698

(51) Int. Cl.[7] ..... G09G 5/00

(52) U.S. Cl. ..... 345/204; 345/74; 345/55; 345/84; 345/74.1; 345/87; 345/88; 345/100; 345/75.1; 345/75.2; 313/309; 313/310; 315/169.1; 315/169.3

(58) Field of Search ..... 345/204, 206, 345/78, 72, 76, 169.3, 74, 74.1, 55, 84, 87, 75.1, 75.2; 315/169.1, 169.3, 169.4; 257/10; 313/309, 310

(56) References Cited

U.S. PATENT DOCUMENTS

| | | | | |
|---|---|---|---|---|
| 5,202,605 A | * | 4/1993 | Kaneko et al. | 313/444 |
| 5,936,257 A | * | 8/1999 | Kusunoki et al. | 257/10 |
| 6,046,542 A | * | 4/2000 | Silva et al. | 313/497 |
| 6,538,391 B1 | * | 3/2003 | Suzuki et al. | 315/169.3 |

FOREIGN PATENT DOCUMENTS

| | | |
|---|---|---|
| JP | 4-289644 | 10/1992 |
| JP | 9-219164 | 8/1997 |

OTHER PUBLICATIONS

Yamaguchi et al., "A 10–in. surface–conduction electron–emitter display", SID, vol. 5, No. 4, pp. 345–348, 1997.

Hosokawa et al., "Organic Multicolor EL Display with Fine Pixels", SID, International Symposium Proceedings, pp. 1073–1076, 1997.

Shimoda et al., Invited Paper: Current Status and Future of Light–Emitting Polymer Display Driven by Poly–Si TFT, SID, International Symposium Proceedings, pp. 372–375, 1999.

Suzuki et al., "Emission and Beam–Divergence Properties of an MIM–Cathode Array for Display Applications", SID, International Symposium Proceedings, pp. 123–126, 1997.

Dawson et al., "A Poly–Si Active–Matrix OLED Display with Integrated Drivers", SID, International Symposium Proceedings, pp. 438–441, 1999.

Gamo et al., Actively–Controllable Filed Emitter Arrays with Built–in Thin–Film Transistors on Glass for Active–Matrix FED Applications, IDW, pp. 667–670, 1998.

* cited by examiner

*Primary Examiner*—Richard Hjerpe
*Assistant Examiner*—Ali Zamani
(74) *Attorney, Agent, or Firm*—Miles & Stockbridge P.C.

(57) ABSTRACT

A display apparatus capable of reducing power consumption comprising a display element, said display element comprising a first substrate, and a second substrate having phosphors;

said first substrate comprising a plurality of transistor elements, a plurality of electron emitter elements, a plurality of first signal lines stretched in a first direction, and a plurality of second signal lines stretched in a second direction perpendicular to said first direction;

each of said electron emitter elements being provided for one of said transistor elements, having a structure comprising a base electrode, an insulator and a top electrode stacked as layers placed one on another in this order of enumeration, and emitting electrons when a positive-polarity voltage is applied to said top electrode;

wherein each of said transistor elements and each of said electron emitter elements are provided in each intersection region of said plurality of first signal lines and said plurality of second signal lines.

27 Claims, 14 Drawing Sheets

DISPLAY APPARATUS

BACKGROUND OF THE INVENTION

1. Field of the Invention

The present invention relates to a display apparatus, particularly relates to an effective technology applied to a display apparatus for displaying a picture, wherein light-emission elements are arranged to form a matrix and the picture is displayed by controlling light emissions of the light-emission elements.

2. Description of Prior Art

A matrix-type display apparatus has a plurality of rows and a plurality of columns arranged in directions orthogonal to each other. Each of the rows and the columns has a plurality of electrodes. Each intersection of any of the rows and any of the columns in the matrix-type display apparatus is referred to as a pixel. A matrix-type display apparatus displays a picture by adjusting a voltage applied to each pixel. Examples of a matrix-type display apparatus are a liquid-crystal display (LED) apparatus, a field-emission display (FED) apparatus, an electro-luminescence (EL) display apparatus and a light-emitting diode (LED) display apparatus.

As disclosed in Japanese publication of unexamined applications No.4-289644, electron emitter elements arranged in an FED apparatus each serve as a pixel. Electrons emitted from the electron emitter elements are accelerated in a vacuum before being radiated to phosphors to cause portions of the phosphors hit by the radiated electrons to emit lights.

As typical electron emitter elements used in an FED apparatus, a matrix of thin-film electron emitters is available. A thin-film electron emitter element is an electron emitter element that utilizes hot electrons generated by applying a strong electric field to an insulator.

An MIM (Metal-Insulator-Metal)-type electron emitter is a representative electron emitter. The following description explains the MIM-type electron emitter with a structure having 3 layers, namely, a top electrode, an insulator and a base electrode.

FIG. 21 is an explanatory diagram used for describing the principle of operation of an MIM-type electron emitter.

If a driving voltage is applied between a top electrode 11 and a base electrode 13 to set an electric field in a tunneling insulator 12 at a value in the range 1 to 10 MV/cm or greater, electrons in close proximity to the Fermi level in the base electrode 13 travel through the barrier by the tunneling phenomenon, becoming hot electrons injected into the conduction band of the top electrode 11.

In the tunneling insulator 12 and the top electrode 11, some of the hot electrons are scattered by interactions with a solid, losing energy.

As a result, at the time the hot electrons reach the boundary between the top electrode 11 and a vacuum 10, the hot electrons have different amounts of energy.

Some of the hot electrons having energy of an amount not smaller than a work function (Φ) of the top electrode 11 are emitted to the vacuum 10 while the remaining hot electrons flow into the top electrode 11.

The MIM-type thin-film electron emitter is disclosed in, among other documents, Japanese publication of unexamined applications No.9-320456.

A plurality of top electrodes 11 are arranged to form typically a column of a matrix while a plurality of base electrodes 13 are arranged to form typically a row of the matrix. A plurality of such rows and a plurality of such columns are laid out in directions orthogonal to each other to form the matrix. An intersection of a row and a column has a top electrode 11 on the column and a base electrode 13 on the row. Such an intersection is referred to as a thin-film electron emitter. Since each MIM-type thin-film electron emitter in the matrix is capable of emitting an electron beam, the thin-film electron emitter serves as an electron emitter element of a matrix-type display apparatus.

Each of the MIM-type thin-film electron emitters in the matrix is a pixel of the display apparatus. In the display apparatus with such a configuration, electrons emitted by each of the MIM-type thin-film electron emitter in the matrix are accelerated in the vacuum 10 before being radiated to phosphors to cause portions of the phosphors hit by the radiated electrons to emit lights to display a desired picture.

The thin-film electron emitter displays excellent characteristics, which qualify the electron emitter to serve as an electron emitter element for FED. The excellent characteristics include the fact that the thin-film electron emitter satisfies a requirement for implementation of a high-resolution display apparatus due to its excellence in the directionality of its emitted electron beam. Another example of the excellent characteristics is easy handling attributed to the fact that the thin-film electron emitter is not severely affected by surface contamination.

SUMMARY OF THE INVENTION

Since the display apparatus using a matrix of thin-film electron emitters employs neither a shadow mask nor beam-deflection circuitry, unlike a cathode-ray tube (CRT), the power consumption of such a display apparatus is slightly smaller than or about equal to that of a CRT display apparatus.

The power consumption of a matrix of thin-film electron emitters driven by adopting the conventional driving technique in a display apparatus employing the matrix of thin-film electron emitters is estimated as follows.

FIG. 22 is a diagram showing the configuration of the conventional matrix of thin-film electron emitters in a simple and plain manner.

A row electrode 310 stretched in the row direction is connected to one of the electrodes, that is, the base electrode 13, of each thin-film electron emitter element 301 associated with the row electrode 310. On the other hand, a column electrode 311 stretched in the column direction is connected to the other electrode, that is, the top electrode 11, of each thin-film electron emitter element 301 associated with the column electrode 311.

It should be noted that, while FIG. 22 shows the configuration of a typical matrix of 3 rows×3 columns, in actuality, the matrix has as many laid-out thin-film electron emitter elements 301 as pixels composing the display apparatus or sub-pixels composing a color display apparatus.

Assume that a negative voltage pulse (−V1) is applied to the row electrode 310 on the R2th row and a positive voltage pulse (+V2) is applied to the column electrode 311 on the C2th column. In this case, since a voltage of (V1+V2) is applied to the thin-film electron emitter element 301 at an intersection (R2, C2) of the row electrode 310 on the R2th row and the column electrode 311 on the C2th column, the thin-film electron emitter element 301 emits electrons.

The emitted electrons are accelerated and then radiated to phosphors, causing the phosphors to emit lights.

In a line-at-a-time operation, a pixel emits a light during a period in a unit time. The ratio of the period to the unit time is referred to as a duty ratio, which is inversely proportional to a scanning-line count N, that is, the number of row electrodes 310. That is, the brightness of the screen is proportional to 1/N.

As indicated in the 1997 SID International Symposium Digest of Technical Papers, pages 123 to 126 (May 1997), however, the brightness of a light emitted during application of a voltage pulse in a display apparatus employing thin-film electron emitter elements 301 and phosphors is sufficiently high so that enough screen brightness is obtained even if a line-at-a-time operation is adopted.

In addition, a relation between the applied voltage and the brightness exhibits a steep threshold characteristic. Thus, even for N of about 1,000, passive-matrix addressing results in sufficient contrast.

That is, unlike a liquid-crystal display apparatus, in the case of a display apparatus employing thin-film electron emitters, it is not necessary to provide a switching element on each pixel in order to improve the threshold characteristic and to increase the duty ratio of the light emitting period.

Next, let us find a dissipation power of drivers in the configuration shown in FIG. 22.

The dissipation power is a power consumed in electrically charging and discharging a capacitance employed in thin-film electron emitter elements 301 being driven by the driver. Thus, the dissipation power does not contribute to light emission by the thin-film electron emitter element 301. Assume that the capacitance of the capacitor employed in a thin-film electron emitter element 301 is Ce, the number of column electrodes 311 is M and the number of row electrodes 310 is N. In this case, the dissipation power for a one-time application of a pulse with an amplitude of Vr to a row electrode 310 is expressed by Eq. (1) as follows.

$$\text{Dissipation power} = M \cdot Ce \cdot Vr^2 \quad (1)$$

Let a symbol f denote a field frequency, which is the number times the screen is updated in 1 second. In this case, the dissipation power Pr of the N row electrodes 310 in 1 second is expressed by Eq. (2) as follows:

$$Pr = f \cdot N \cdot M \cdot Ce \cdot Vr^2 \quad (2)$$

Since N thin-film electron emitter elements 301 are connected to each column electrode 311, the dissipation power Pc, which is incurred when a pulse voltage is applied to all M column electrodes 311, is expressed by Eq. (3) as follows:

$$Pc = f \cdot M \cdot N \cdot (N \cdot Ce \cdot Vc^2) \quad (3)$$

where a symbol Vc is the amplitude of the voltage pulse applied to the column electrodes 311.

As is obvious from Eqs. (2) and (3), the expression of the dissipation power Pc has an additional multiplicand N in comparison with the dissipation power Pr. This is because, in 1 field period, N consecutive pulses are applied to the column electrodes 311 where the field period is a period during which the screen is updated once.

If the voltage pulse with the amplitude Vc is applied only to m column electrodes 311 among the M column electrodes 311, the dissipation power can be obtained by substituting m for M in Eq. (3).

As an example, assume the following representative values: f=60 Hz, N=480, M 32 1,920, Ce=0.1 nF and Vr=Vc= 4V. In this case, the dissipation powers are found to be Pr =0.09 W and Pc =42 W.

Since the power consumption of the thin-film electron emitter elements 301 themselves is about 1.6 W, the total power consumption is about 44 W, a value causing no problem in practical use.

When it is desired to further reduce the power consumption, however, reduction of the dissipation power Pc accompanying application of the data pulses is obviously a known effective method.

As described above, when the display apparatus is used as a display apparatus corresponding to a CRT, even with the conventional technology, there is no power-consumption problem.

However, a feature of the display apparatus employing a matrix of thin-film electron emitters is its feasible implementation as a thin display apparatus.

Such a thin display apparatus also has an application as a portable display apparatus. In this application, it is desired to further reduce the power dissipation.

In addition, the effective impedance of each thin-film electron emitter element 301 is small. That is, since a relatively large current flows to the thin-film electron emitter element 301, when the matrix of thin-film electron emitters is driven in a line-at-a-time operation, currents flow through a number of thin-film electron emitter elements pertaining to an electrode, raising problems such as the fact that brightness uniformity over the entire screen cannot be obtained unless resistivity along each feeding line is reduced.

The same problems are also encountered in a display apparatus employing an electro-luminescence(EL) array or a matrix of organic EL elements, which are also called organic light-emitting diodes (OLEDs).

The present invention aims at solving the problems by providing a technology of reducing power consumption in a display apparatus.

The present invention also aims at providing a technology of improving an image quality in a display apparatus.

The above and other objects as well as novel characteristics of the present invention will become apparent from the description and accompanying diagrams given in this specification.

First of all the principle of operation of the present invention is explained.

FIG. 1 is a diagram showing a typical configuration of a thin-film matrix of a display apparatus provided by the present invention in a simple and plain manner.

In the conventional configuration, only a thin-film electron emitter element 301 is connected at a location in close proximity to a region where a row electrode 310 crosses a column electrode 311. In the case of the present invention, however, a pixel transistor 302 and a thin-film electron emitter element 301 are connected at a location in close proximity to a region where a row electrode (a first signal line of the present invention) 310 crosses a column electrode (a second signal line of the present invention) 311, and a driving voltage is supplied to one of the electrodes (the base electrode 13) of the thin-film electron emitter element 301 by way of the pixel transistor 302 as shown in FIG. 1.

To put it in detail, the gate of the pixel transistor 302 is connected to the row electrode 310 and the source of the transistor 302 is connected to the column electrode 311. The drain of the transistor 302 is connected to the one of the electrodes (the base electrode 13) of the thin-film electron emitter element 301.

The other electrode (the top electrode 11) of the thin-film electron emitter element 301 is connected to a top-electrode driver 45.

It should be noted that, if a TFT (thin-film transistor) is employed as the pixel transistor 302, the drain and the source thereof are virtually not distinguished from each other. In this specification, however, the terms source and drain are used for convenience sake even in the case of a TFT (thin-film transistor).

In this specification, a region surrounding or in the vicinity of a cross point of a row electrode 310 and a column electrode 311 is referred to as an intersection region. An region enclosed by a row electrode 310 and a column electrode 311 is referred to as a pixel in the following description. The transistor 302 provided in the pixel region is referred to as a pixel transistor.

In the case of a color display apparatus, a combination of red, blue and green sub-pixels actually constitutes a pixel. In the case of a color display apparatus, however, by a pixel, a sub-pixel is implied in this specification. Word "dot" is also used to denote a pixel or a sub-pixel.

The thin-film electron emitter element 301 at an intersection region (R2,C2) of the row electrode 310 on the R2th row and the column electrode 311 on the C2th column operates as follows.

A pulse voltage is applied to the row electrode 310 on the R2th row to turn on the pixel transistor 302 (or to put the pixel transistor 302 in a conductive state).

At the same time, if a pulse having a voltage amplitude of V2 is applied to the column electrode 311 on the C2th column, a voltage of (Vcom −V2−ΔV) is applied to the thin-film electron emitter element 301 at the intersection region (R2,C2), causing the thin-film electron emitter element 301 to emit electrons.

A symbol Vcom denotes the output voltage of the top-electrode driver 45 and a symbol ΔV denotes a voltage drop along the resistor (or the output impedance) of the pixel transistor 302.

At dots connected to the row electrodes 310 on the R1th and R3th rows, the pixel transistors 302 are in an OFF state. Thus, no voltages are applied to the thin-film electron emitter elements 301 connected to these pixel transistors 302 and the thin-film electron emitter elements 301 therefore emit no electrons. In this way, the present invention displays an image in accordance with the line-at-a-time scheme.

The following description explains estimation of a dissipation power consumed by drivers in an application using the present invention.

The dissipation power Pr of a row-electrode driver 41 is expressed by Eq. (4) as follows:

$$Pr=f\cdot N\cdot M\cdot Cgs\cdot Vr^2 \quad (4)$$

where a symbol Vr denotes the amplitude of a voltage pulse applied to a row electrode 310 and a symbol Cgs denotes the stray capacitance between the gate and the source of the pixel transistor 302 at each dot.

Normally, the stray capacitance Cgs is about 1 pF. Since this stray capacitance Cgs is about 1/100 to 1/1000 of the capacitance Ce of the thin-film electron emitter element 301, the dissipation power Pr is also about 1/100 to 1/1000 of a dissipation power according to the conventional method.

On the other hand, the dissipation power Pc of a column-electrode driver 42 is expressed by Eq. (5) as follows:

$$Pc=f\cdot M\cdot N\cdot Ce\cdot Vc^2+f\cdot M\cdot N\cdot(N-1)\cdot Cdse\cdot Vc^2 \quad (5)$$

In Eq. (5), the first term is a term attributed to dots at which the pixel transistors 302 are each put in a conducting state and the second term is a term attributed to other dots, that is, dots at which the pixel transistors 302 are each put in a non-conducting state.

In Eq. (5), a symbol Vc denotes the amplitude of a voltage pulse applied to a column electrode 311 and a symbol Cdse denotes a combined capacitance of the capacitance Ce of a thin-film electron emitter element 301 and the stray capacitance Cds between the drain and the source of a pixel transistor 302. The combined capacitance Cdse is expressed by Eq. (6) as follows:

$$Cdse=(1/Cds+1/Ce)^{-1}=Cds/(Cds/Ce+1) \quad (6)$$

Normally, the stray capacitance Cds is about 1 pF. Since this stray capacitance Cds is about 1/100 to 1/1000 of the capacitance Ce of the thin-film electron emitter element 301, the combined capacitance Cdse is about equal to the stray capacitance Cds, which is about 1/100 to 1/1000 of the capacitance Ce.

Thus, the dissipation power Pc can be reduced to about 1/N of the dissipation power according to the conventional method.

In this way, the dissipation powers of the row-electrode drivers 41 and the column-electrode driver 42 according to the present invention can be reduced considerably.

In addition, since the load capacitance of each of the row-electrode drivers 41 and column-electrode drivers 42 is reduced, requirement to the row-electrode driver 41 and the column-electrode driver 42 are relaxed. As a result, the scheme provided by the present invention contributes to cost reduction of the row-electrode driver 41 and the column-electrode driver 42.

In the display embodiment, there have been proposed and/or implemented techniques for controlling the operation of each pixel by using a transistor provided on the pixel. A technique for controlling the operation of a pixel by using a transistor provided on the pixel is referred to as the active-matrix addressing scheme.

The active-matrix addressing scheme is widely adopted in liquid-crystal display apparatuses. This is because, since the threshold characteristic of the transmittance with respect to the applied voltage of liquid-crystal element is not steep, the adoption of the passive-matrix addressing scheme will decrease the contrast.

The active-matrix addressing technique lengthens the period to apply a voltage to each pixel. In other words, by increasing the duty ratio, the contrast is improved.

On the other hand, the operating mode of each pixel adopted by the present invention is a line-at-a-time scheme. That is, the duty ratio of an emitted light is 1/N and, hence, the operating mode is essentially different from the active-matrix addressing technique adopted in a liquid-crystal display apparatus. Here, the line-at-a-time scheme includes "one-line-at-a-time" and "two-line-at-a-time" schemes; in the latter scheme, the display area is divided into two areas, in each of which the one-line-at-a-time scheme is used, and the duty ratio is 2/N.

As described in the 1999 SID International Symposium Digest of Technical Papers, pages 438 to 441 (May 1999), in an electro-luminescence (EL) display apparatus adopting the active-matrix addressing scheme, a pixel is implemented by a combination of at least 2 transistors and a storage capacitance.

One of the transistors is used for controlling the flow-in and the flow-out of electric charge to and from the storage capacitance. The other transistor controls the light emission from the EL element of the pixel in accordance with the voltage of the storage capacitance.

In this way, the light emission period of the EL element of each pixel, that is, the duty ratio, is increased to give a high luminance. Thus, this technique is also essentially different from the present invention.

As a typical application of the active-matrix addressing scheme to a field emission display (FED) apparatus, a transistor is formed at each dot of a matrix of surface-conduction electron emitters as is described in Japanese publication of unexamined applications No.9-219164.

In this typical application disclosed to the public, in order to prevent a current emitted by a surface-conduction electron emitter from varying from dot to dot, the magnitudes of the currents are made uniform by taking advantage of a constant-current characteristic of a transistor provided at each pixel.

FIG. 2 is a diagram showing a relation between the drain current $I_D$ and the drain-source voltage $V_{DS}$ of a MOS transistor under a condition of a constant gate voltage.

It is obvious from FIG. 2 that, as the drain-source voltage $V_{DS}$ exceeds a predetermined level, that is, the boundary between a non-saturation region and a saturation region, the drain current $I_D$ stays at an all but constant value independently of the voltage $V_{DS}$.

Also for an FED apparatus employing a field-emission array (FEA) as a source of electrons, there has been proposed a scheme in which a transistor is provided at each dot as is described in the Proceedings of the $5^{th}$ International Display Workshops, pages 667 to 670 (December 1998). Much like the display apparatus disclosed to the public as described above, each pixel transistor is operated in the saturation region. The constant-current-characteristic in the saturation region is used to reduce the amount of noise and to stabilize the emitted current.

However, the technique of operating each pixel transistor in its saturation region to take advantage of the constant-current characteristic of the transistor as is disclosed in the announced display apparatuses has a problem caused by a big effect of variations in pixel-transistor characteristic.

The problem is described below.

In general, the drain current Id(sat) in the saturation region of the MOS transistor shown in FIG. 2 can be expressed by Eq. (7) as follows:

$$I_D(sat)=k\cdot(V_{GS}-V_T)^2 \tag{7}$$

where a symbol $V_{GS}$ denotes the voltage between the gate and the source, a symbol $V_T$ denotes a threshold value and a symbol k denotes a quantity that can be expressed by Eq. (8) in terms of a mobility $\mu_n$ of a semiconductor composing the MOS transistor, a gate capacitance $C_{ox}$ and geometrical parameters (W/L) of the MOS transistor as follows:

$$k=(1/2)\mu_n C_{ox}(W/L) \tag{8}$$

In actual MOS transistors, there are variations in threshold value $V_T$ from transistor to transistor. Since the drain current $I_D$ (sat) in the saturation region is proportional to the square of $(V_{GS}-V_T)$, the effect of the variations in threshold value $V_T$ from transistor to transistor is big.

Thus the technique of operating each pixel transistor in its saturation region to take advantage of the constant-current characteristic of the transistor has a problem of a necessity to form pixel transistors with a high degree of uniformity in order to overcome the big effect of the variations in threshold value $V_T$ from transistor to transistor.

If a thin-film transistor (TFT) made of a material such as amorphous silicon or poly-silicon is employed as a pixel transistor, it is particularly difficult to keep the uniformity of the pixel TFTs. The amorphous silicon and the poly-silicon are referred to hereafter simply as a-Si and poly-Si respectively.

In the present invention, in order to reduce the effect of variations in characteristic from transistor to transistor, each pixel transistor 302 is operated in its non-saturation region. That is, each pixel transistor 302 is operated in a region where the drain current $I_D$ varies greatly with the voltage $V_{DS}$ applied between the drain and the source of the pixel transistor 302.

In the characteristic of FIG. 2 representing a relation between the drain current $I_D$ and the voltage $V_{DS}$ between the drain and the source, the reciprocal of the slope of the curve in the non-saturation region, that is, the effective resistance R or the output impedance, is expressed by Eq. (9) as follows:

$$R=\left(\frac{dI_D}{dV_{DS}}\right)^{-1}=\{2k(V_{GS}-V_T)\}^{-1} \tag{9}$$

Since Eq. (9) obviously indicates that the characteristic in the non-saturation region is dependent only on the reciprocal of $(V_{GS}-V_T)$, the effects of variations in threshold value $V_T$ from transistor to transistor is small in comparison with the effect on the drain current $I_D$ (sat) in the saturation region.

Next, assume a case in which the thin-film electron emitter element (or the MIM electron emitter element) 301 is connected in series to the pixel transistor 302 as shown in FIG. 1 and an external voltage $V_o$ is applied to the entire serial connection. In this case, the effect of variations in output impedance R from transistor to transistor on a current flowing to the thin-film electron emitter element 301 is estimated as follows.

Id=f (V) indicates that the diode current Id of the thin-film electron emitter element 301 is a function of voltage V. Conversely speaking, $V=f^{-1}$ (Id) Let symbols I and I+ΔI denote currents that flow when the output impedance of the pixel transistor is R and (R+ΔR) respectively where a symbol ΔR denotes variations ΔR in characteristic from transistor to transistor. In this case, Eq. (10) holds true as follows:

$$\frac{\Delta I}{I}=\left(\frac{\Delta R}{R+\Delta R}\right)\Big/(I+\alpha) \tag{10}$$

$$\alpha=\frac{r_e}{R+\Delta R}$$

$$r_e=\frac{dV}{dI_d}$$

where $\alpha=r_e/(R+\Delta R)$ and $r_e=dV/dI_d$, the derivative of the inverse function $f^{-1}$ with respect to Id.

Thus, by setting the output impedance (R+ΔR) of the pixel transistor 302 at a value smaller than the differential resistance $r_e$ (at the operation point) of the thin-film electron emitter element 301, the relation $\alpha \geqq 1$ holds true. In this case, Eq. (11) can be derived from Eq. (10) as follows:

$$\frac{\Delta I}{I}\leq\frac{1}{2}\left(\frac{\Delta R}{R+\Delta R}\right) \tag{11}$$

In this way, the effects of variations ΔR in characteristic from transistor to transistor on the uniformity of the displayed picture can be made even smaller. In other word, the allowance of the variations ΔR in characteristic from transistor to transistor increases, making the fabrication process easy to carry out.

In another technique of reducing the variations ΔR in characteristic from transistor to transistor, the pixel transistor 302 is operated in the non-saturation region and a constant-current circuit is used as the column-electrode driver 42.

In this case, the pixel transistor 302 is employed as a switching element with an on-resistance of R. Even if the effective resistance R of the pixel transistor 302 changes, the current flowing through the thin-film electron emitter element 301 is set by the column-electrode driver 42 at a constant magnitude.

This technique is particularly effective for a case in which a thin-film transistor (TFT) made of a material such as a-Si or poly-Si is employed as the pixel transistor 302 and a single-crystal silicon (Si) substrate is used for the column-electrode driver 42. This is because, by using a single-crystal silicon (Si) substrate, variations in characteristic from transistor to transistor can be suppressed with ease.

The use of a constant-current circuit as the column-electrode driver 42 is specially effective for a case in which variations in relation B=h (I) between the element current I and the brightness B is small in comparison with variations and fluctuations appearing in the relation B=g (V) between the applied voltage V and the brightness B.

The elements adopting the configuration described above include an organic EL (organic electro-luminescence) element, also called an organic light-emitting diode (OLED), and a light-emitting diode (LED).

Representatives of the present invention described in this specification are explained briefly and simply as follows.

The present invention provides a display apparatus comprising a display element, said display element comprising a first substrate, a frame element, and a second substrate having phosphors, and a space enclosed by said first substrate, said frame element and said second substrate being a vacuum environment;

said first substrate comprising a plurality of transistor elements, a plurality of electron emitter elements, a plurality of first signal lines stretched in a first direction, and a plurality of second signal lines stretched in a second direction perpendicular to said first direction;

each of said electron emitter elements being provided for one of said transistor elements, having a structure comprising a base electrode, an insulator and a top electrode stacked as layers placed one on another in this order of enumeration, and emitting electrons when a positive-polarity voltage is applied to said top electrode;

wherein each of said transistor elements and each of said electron emitter elements are provided in each intersection region of said plurality of first signal lines and said plurality of second signal lines.

In addition, the present invention also provides a display apparatus comprising a display element, said display element comprising a first substrate, a frame element, and a second substrate having phosphors, and a space enclosed by said first substrate, said frame element and said second substrate being a vacuum environment;

said first substrate comprising a plurality of transistor elements, a plurality of electron emitter elements, a plurality of first signal lines stretched in a first direction, and a plurality of second signal lines stretched in a second direction perpendicular to said first direction;

each of said electron emitter elements being provided for one of said transistor elements, having a structure comprising a base electrode, an insulator and a top electrode stacked as layers placed one on another in this order of enumeration, and emitting electrons when a positive-polarity voltage is applied to said top electrode;

wherein each of said transistor elements is provided in each region enclosed by said plurality of first signal lines and said plurality of second signal lines.

Furthermore, the present invention also provides a display apparatus comprising a display element, said display element comprising a first substrate, a frame element, and a second substrate having phosphors, and a space enclosed by said first substrate, said frame element and said second substrate being a vacuum environment;

said first substrate comprising a plurality of transistor elements, a plurality of electron emitter elements, a plurality of first signal lines stretched in a first direction, and a plurality of second signal lines stretched in a second direction perpendicular to said first direction;

each of said electron emitter elements being provided for one of said transistor elements, having a structure comprising a base electrode, an insulator and a top electrode stacked as layers placed one on another in this order of enumeration, and emitting electrons when a positive-polarity voltage is applied to said top electrode;

wherein a control electrode of each of said transistor elements is electrically connected to one of said first signal lines, a first electrode of each of said transistor elements is electrically connected to one of said second signal lines, and a second electrode of each of said transistor elements is electrically connected to said base electrode of said electron emitter element associated with said transistor element.

Moreover, the present invention is characterized in that an output impedance of each of said transistor elements is smaller than a differential resistance in an operation region of one of said electron emitter elements.

In addition, the present invention further comprises a first driving means for supplying a driving voltage to each of said first signal lines, and a second driving means for supplying a driving voltage to each of said second signal lines; and wherein said second driving means has a constant-current circuit.

Furthermore, the present invention also provides a display apparatus comprising a display element, a first driving means and a second driving means;

said display element comprising a first substrate, and a second substrate having phosphors;

said first substrate comprising a plurality of transistor elements, a plurality of electron emitter elements each provided for one of said transistor elements, a plurality of first signal lines stretched in a first direction, and a plurality of second signal lines stretched in a second direction perpendicular to said first direction;

wherein said first driving means supplies a driving voltage to each of said first signal lines, said second driving means supplies a driving voltage to each of said second signal lines, a control electrode of each of said transistor elements is electrically connected to one of said first signal lines, a first electrode of each of said transistor elements is electrically connected to one of said second signal lines, a second electrode of each of said transistor elements is electrically connected to said base electrode of said electron emitter element associated with said transistor element, and said second driving means has a constant-current circuit.

Moreover, the present invention also provides a display apparatus comprising a display element, a first driving means and a second driving means;

said display element comprising a first substrate;

said first substrate comprising a plurality of transistor elements, a plurality of electro-luminescence elements each provided for one of said transistor elements, a plurality of first signal lines stretched in a first direction, and a plurality of second signal lines stretched in a second direction perpendicular to said first direction;

wherein said first driving means supplies a driving voltage to each of said first signal lines, said second driving means supplies a driving voltage to each of said second signal lines, a control electrode of each of said transistor elements is electrically connected to one of said first signal lines, a first electrode of each of said transistor elements is electrically connected to one of said second signal lines, a second electrode of each of said transistor elements is electrically connected to a first electrode of said electro-luminescence element associated with said transistor element, and said second driving means has a constant-current circuit.

In addition, the present invention also provides a display apparatus comprising a display element, a first driving means and a second driving means;

said display element comprising a first substrate;

said first substrate comprising a plurality of transistor elements, a plurality of light-emitting diode elements each provided for one of said transistor elements, a plurality of first signal lines stretched in a first direction, and a plurality of second signal lines stretched in a second direction perpendicular to said first direction;

wherein said first driving means supplies a driving voltage to each of said first signal lines, said second driving means supplies a driving voltage to each of said second signal lines, a control electrode of each of said transistor elements is electrically connected to one of said first signal lines, a first electrode of each of said transistor elements is electrically connected to one of said second signal lines, a second electrode of each of said transistor elements is electrically connected to a first electrode of said light-emitting diode element associated with said transistor element, and said second driving means has a constant-current circuit.

Furthermore, the present invention is characterized in that each of said transistor elements is a thin-film transistor, which is operated in a non-saturation region thereof.

BRIEF DESCRIPTION OF THE DRAWINGS

Other objects and advantages of the invention will become apparent during the following discussion of the accompanying drawings, wherein.

DETAILED DESCRIPTION OF THE PREFERRED EMBODIMENTS

Figure 1:
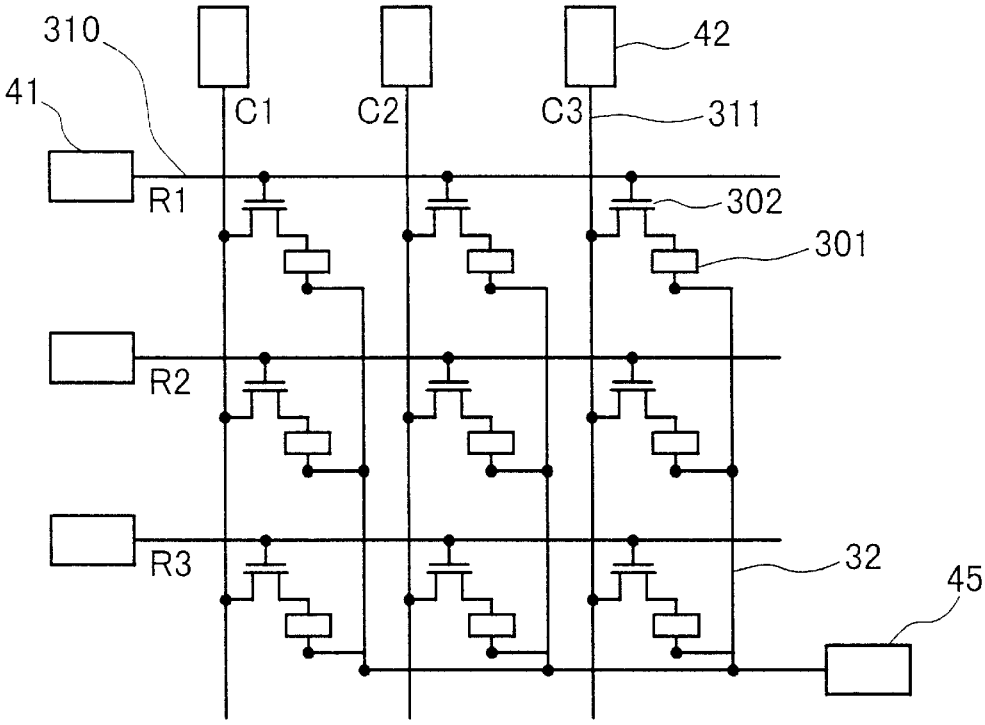
FIG. 1 is a diagram showing a typical configuration of a thin-film matrix of a display apparatus provided by the present invention in a simple and plain manner.
Figure 2:
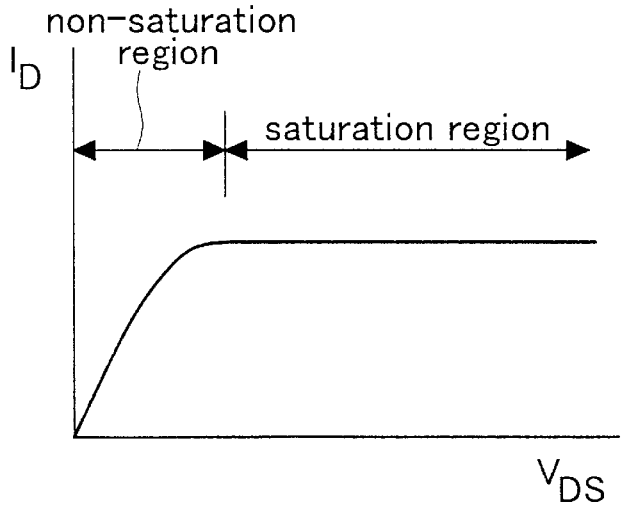
FIG. 2 is an explanatory diagram showing a relation between the drain current and the drain-source voltage of a MOS transistor under a condition of a constant gate voltage.

Some preferred embodiments of the present invention are described by referring to diagrams.

It should be noted that identical functions and identical components shown throughout all the diagrams, which are referred to in the explanation of the embodiments, are denoted by the same reference numerals, and their description is given only once.

First Embodiment

A display apparatus implemented by a first embodiment of the present invention employs a display panel (a display element of the present invention) having brightness modulation elements, which are implemented as a combination of phosphors and a matrix of thin-film electron emitters and are each provided for a dot. The thin-film electron emitters each serve as a source emitting electrons. Row electrodes and column electrodes of the matrix employed in the display panel are connected to their respective drivers.

The display panel thus has an electron-emitter plate including the electron-emitter matrix and a phosphor plate having a pattern of the phosphors.

First of all, the description begins with an explanation of a layout of pixel transistors 302, the structure of the electron-emitter plate having the matrix of thin-film electron emitters, a method of fabricating the pixel transistors 302 and a method of fabricating the electron-emitter plate in this embodiment with reference to FIGS. 3, 4A and 4B, 5A to 5H and 6A to 6L.

Figure 3:
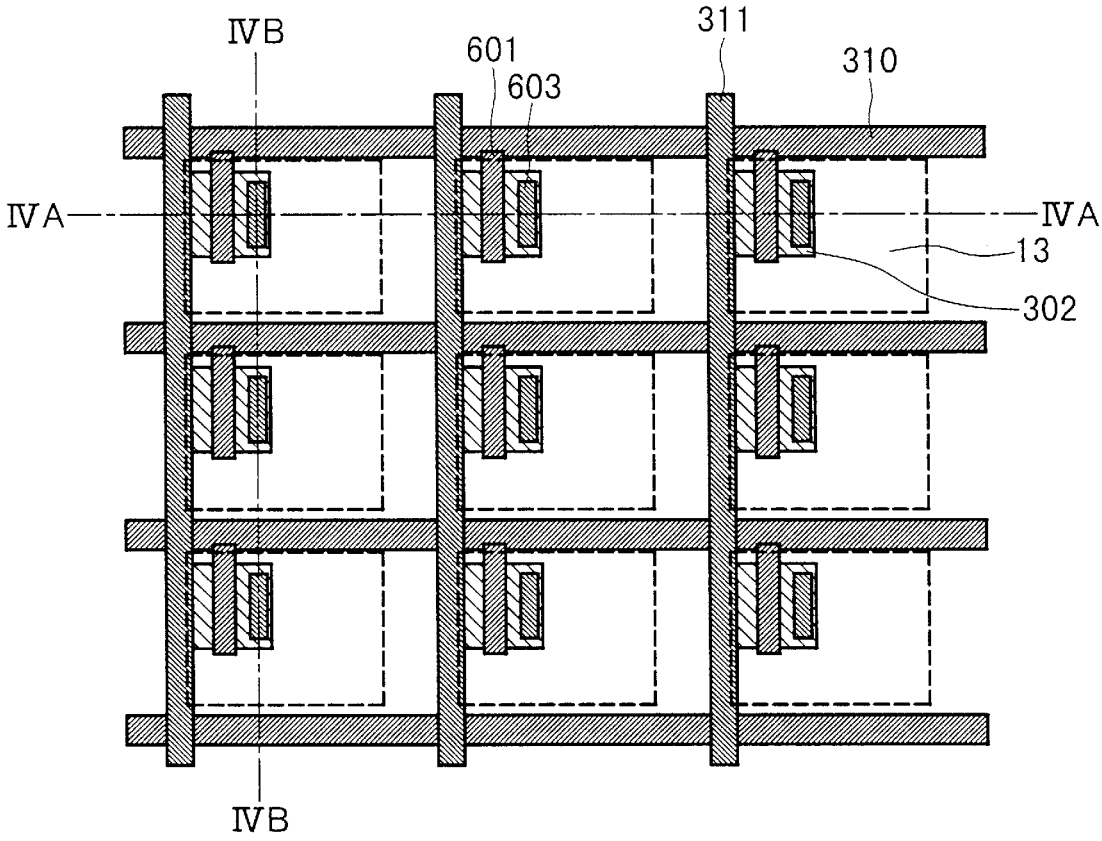
FIG. 3 is a diagram showing a top view of a layout of pixel transistors provided by a first embodiment of the present invention.

FIG. 3 is a diagram showing a top view of a layout of the pixel transistors 302 provided by this embodiment.

Figure 4A:
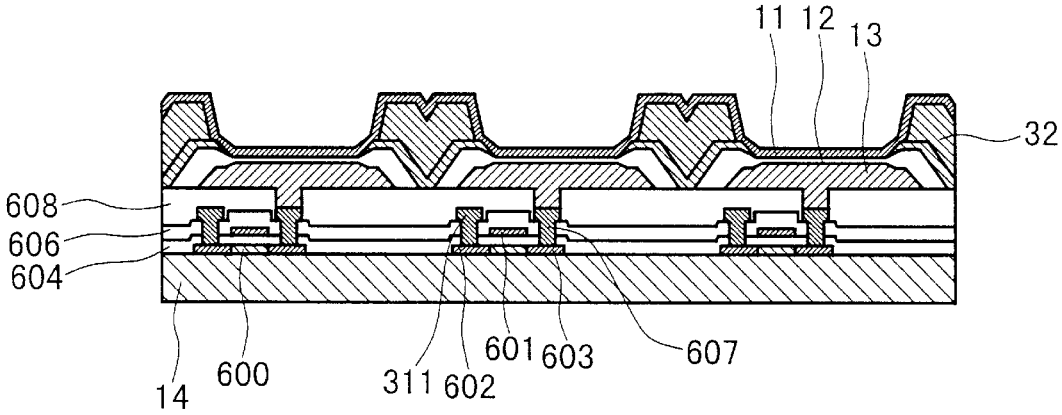
FIG. 4 is diagrams each showing a cross section of the structure of major components composing an electron-emitter plate provided by the first embodiment of the present invention.
Figure 4B:
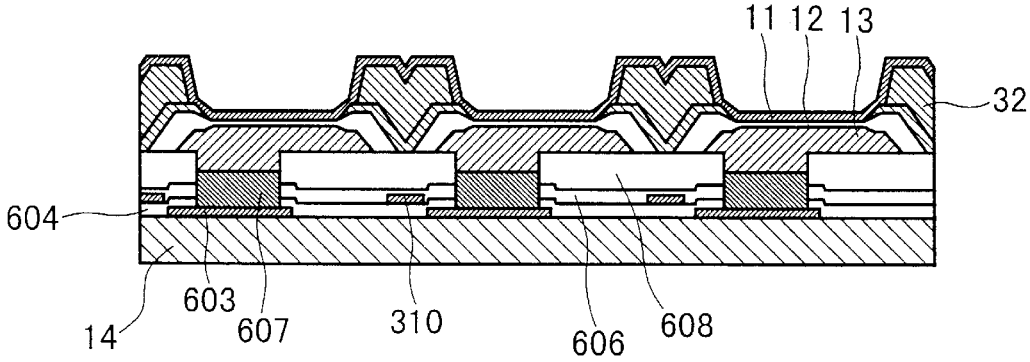

FIGS. 4A and 4B are each a diagram showing a cross section of the structure of major components composing the electron-emitter plate provided by this embodiment. To be more specific, FIG. 4A is a diagram showing a cross section along a crossing line IVA—IVA shown in FIG. 3 and FIG. 4B is a diagram showing a cross section along a crossing line IVB—IVB shown in FIG. 3.

FIGS. 5A to 5H are explanatory diagram used for describing a method of fabricating the pixel transistors 302 provided by this embodiment;

FIGS. 6A to 6L are explanatory diagram used for describing a method of fabricating the matrix of thin-film electron emitters provided by this embodiment.

The method of fabricating the pixel transistors 302 provided by this embodiment is explained by referring to FIGS. 5A to 5H.

Figure 5A:
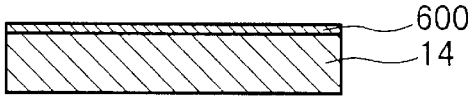
FIGS. 5A to 5H are explanatory diagrams used for describing a method of fabricating pixel transistors employed in the first embodiment of the present invention.

First of all, by using a low-pressure CVD method with disilane ($Si_2H_6$) used as a raw-material gas, an a-Si film is deposited on a substrate 14 and, then, a laser-anneal process is carried out on the entire surface to form a poly-Si film 600 as shown in FIG. 5A.

In this case, as the substrate 14, non-alkali glass, or non-alkali- or sodalime-glass covered by silicon dioxide ($SiO_2$) is used.

Figure 5B:
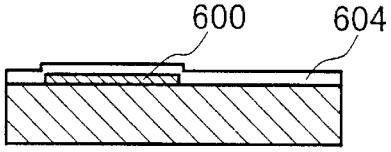

Then, after the poly-Si film 600 is patterned, a gate insulator 604 made of $SiO_2$ is formed by using a CVD method as shown in FIG. 5B.

Figure 5C:
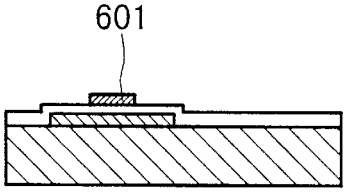
Figure 5D:
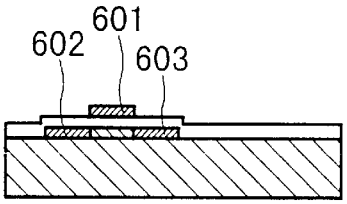

Then, after a gate 601 is formed by injecting impurities into the poly-Si film 600 with ion doping as shown in FIG. 5C. Accordingly, a source 602 and a drain 603 are formed as shown in FIG. 5D.

Figure 5E:
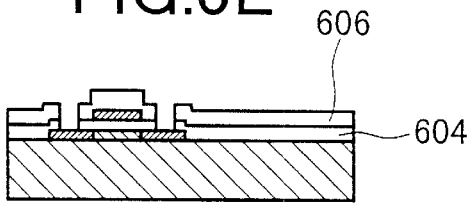

Then, after an inter-layer insulator 606 is formed, contact holes are bored as shown in FIG. 5E.

Figure 5F:
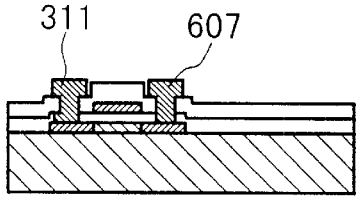

Subsequently, a column electrode 311 and a contact electrode 607 are formed as shown in FIG. 5F.

Figure 5G:
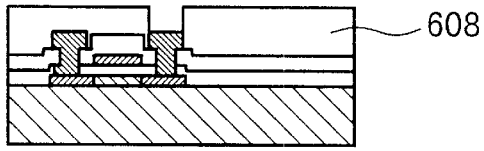

Then, after an SiO2 passivation layer 608 is formed, a contact hole is bored as shown in FIG. 5G.

Figure 5H:
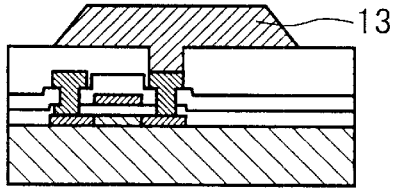

Finally, after a aluminum(Al)-neodymium (Nd) alloy film is formed, a base electrode 13 is formed as shown in FIG. 5H.

The base electrode 13 is formed on a pattern indicated by a block enclosed by a dotted line shown in FIG. 3.

Next, the method of fabricating a thin-film electron emitter element 301 of the thin-film electron-emitter matrix is explained by referring to FIGS. 6A to 6L.

FIGS. 6G to 6L are top-view diagrams and FIGS. 6A to 6F are cross-sectional diagrams corresponding to FIGS. 6G to 6L respectively.

Figure 6A:
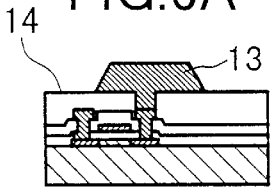
FIG. 6 is an explanatory diagram used for describing a method of fabricating a matrix of thin-film electron emitters employed in the first embodiment of the present invention.

FIG. 6A is the same as FIG. 5H.

Figure 6B:
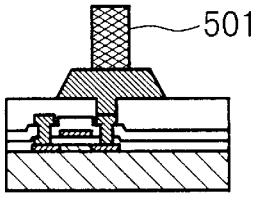

First of all, a resist 501 is formed on the base electrode 13 as shown in FIG. 6B.

Figure 6C:
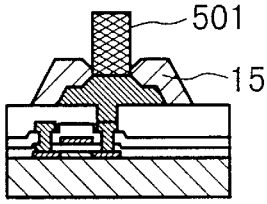

In this state, anodic oxidation is carried out to form a protection insulator 15 as shown in FIG. 6C. In the anodic oxidation of this embodiment, the anodization voltage is set at about 20V, and accordingly the film thickness of the protection insulator 15 is set at about 30 nm.

Figure 6D:
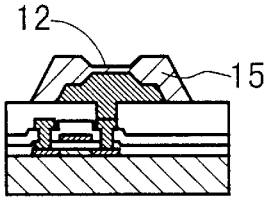

After the resist pattern 501 is removed by using an organic solvent such as acetone, the surface of the base electrode 13 covered so far by the resist 501 is again subjected to anodic oxidation to form a tunneling insulator 12 as shown in FIG. 6D. In the anodic oxidation of this embodiment, the anodization voltage is set at 6 V, and, accordingly the film thickness of the protection insulator 12 is set at about 8 nm.

Figure 6E:
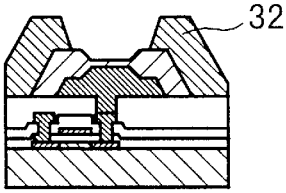

Then, a conductive layer for a top-electrode bus line is formed, a resist is patterned and etching is carried out to form the top-electrode bus line as shown in FIG. 6E.

In this embodiment, top-electrode bus lines 32 are formed as a stacked-layer film having an Al alloy with a film thickness of about 300 nm and a tungsten (W) film with a thickness of about 20 nm. The Al alloy and the W film are formed by 2-step etching.

It should be noted that, as a material for forming the top-electrode bus-line 32, gold (Au) can also be used.

The top-electrode bus-lines 32 are etched so that its edge is formed into a taper shape.

Figure 6F:
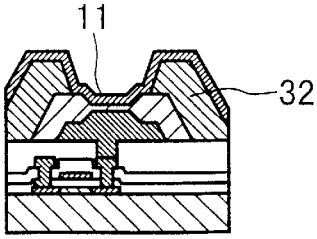
Figure 6G:
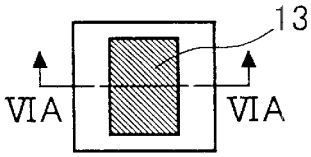
Figure 6H:
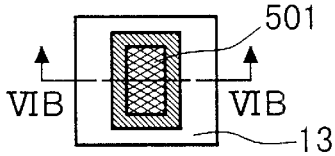
Figure 6I:
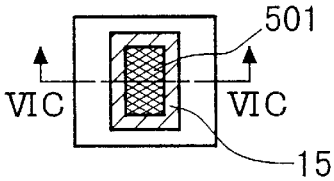
Figure 6J:
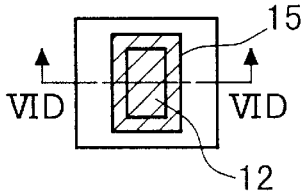
Figure 6K:
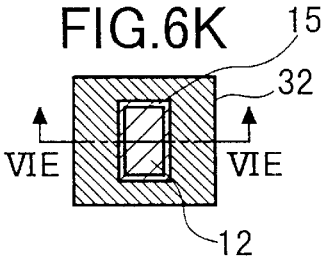
Figure 6L:
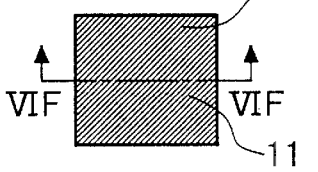

Finally, a top electrode 11 is formed on the entire surface as shown in FIG. 6F.

In this embodiment, the top electrode 11 is formed as a 3-layer-stacked film having 3 layers, namely, an iridium (Ir) layer with a thickness of 1 nm, a platinum (Pt) layer with a thickness of 2 nm and a gold (Au) layer with a thickness of 3 nm, which are stacked on each other in an order the layers are enumerated.

The top electrode 11 is formed on the entire surface of the image display area but not on a region for forming pad electrodes in substrate peripheries.

Since the precision of the patterning required for the top electrode 11 is extremely loose, the patterning of the top electrode 11 in this embodiment is carried out by using a metallic mask.

By doing so, no resist is left on the surface of the top electrode 11 as a residue after the fabrication of the top electrode 11. Thus, a clean top electrode 11 can be obtained with ease and electron emission characteristics do not deteriorate.

A clean top electrode 11 can be obtained with ease and with no deterioration in electron emission characteristic because the top electrode 11 is formed after the fabrication of the top-electrode bus-lines 32.

By carrying out the processes described above, the fabrication of the matrix of thin-film electron emitters on the substrate 14 is completed.

In the matrix of thin-film electron emitters provided by this embodiment, electrons are emitted from a region defined by the tunneling insulator 12 (or the electron emission region 18 shown in FIG. 8), that is, a region defined by the resist pattern 501.

On the periphery of the electron emission region 18, a thick protection insulator 15 is formed. Thus, an electric field applied between the top electrode 11 and the base electrode 13 is no longer concentrated on the edge of the base electrode 13. As a result, a stable electron emission characteristic is obtained over a long period of time.

In this embodiment, the pixel transistor 302 and the thin-film electron emitter element 301 are formed on substrate 14 as different layers as is obvious from FIG. 4.

Accordingly, the size of the pixel transistor 302 can be increased without decreasing the size of the thin-film electron emitter element 301 as is obvious from FIG. 3.

Accordingly, the output impedance of the pixel transistor 302 can be reduced with ease. In this embodiment, the output impedance of the pixel transistor 302 is set at a value smaller than the differential resistance $r_e$ in the operation region of the thin-film electron emitter element 301. By doing so, it is possible to make the variations in characteristic from transistor to transistor hardly cause brightness non-uniformity of the displayed picture.

As is obvious from the top view of FIG. 3, the pixel transistor 302 is provided beneath the base electrode 13. In this configuration, the base electrode 13 also serves as a light-blocking layer of the pixel transistor 302.

Next, the structure of the display panel provided by this embodiment is explained by referring to FIGS. 7, 8, 9A and 9B.

Figure 7:
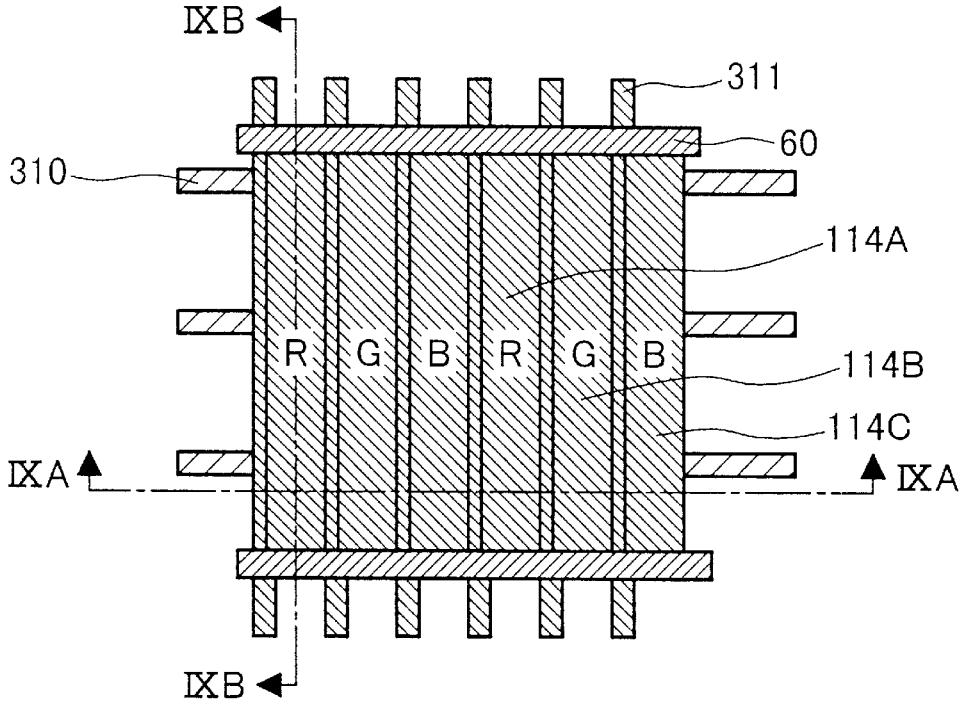
FIG. 7 is a top view of a display panel provided by the first embodiment of the present invention as seen from a phosphor-plate side.
Figure 8:
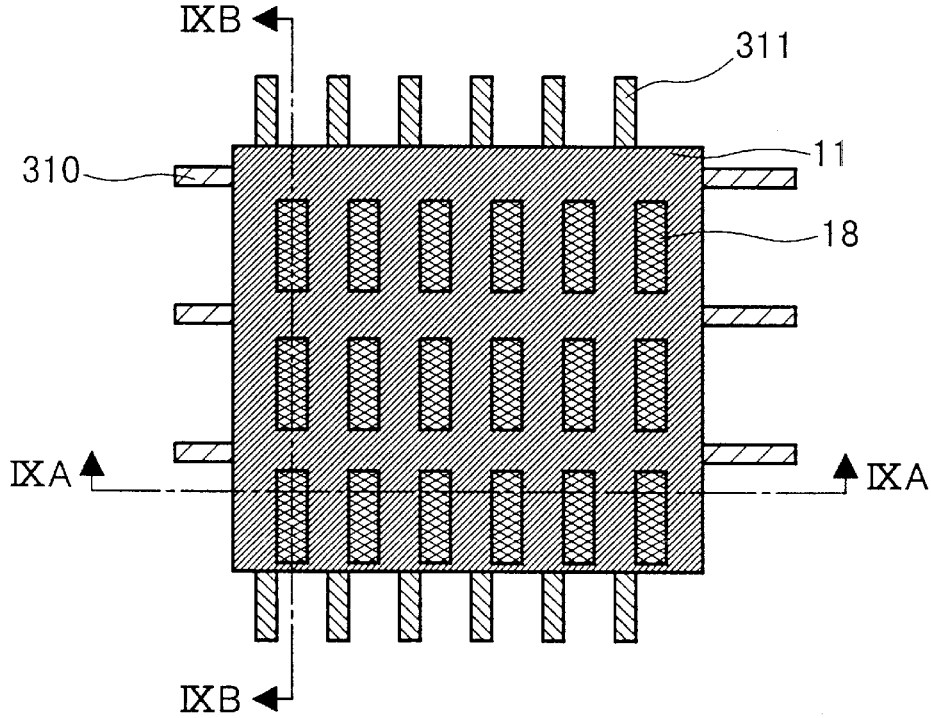
FIG. 8 is a top view of an electron-emitter plate as seen from the phosphor-plate side of the display panel provided by the first embodiment of the present invention with the phosphor plate removed from the display panel.

FIG. 7 is a top view of the display panel provided by this embodiment as seen from the phosphor-plate side and FIG. 8 is a top view of the substrate 14 as seen from the phosphor-plate side of the display panel provided by this embodiment with the phosphor plate removed from the display panel.

Figure 9A:
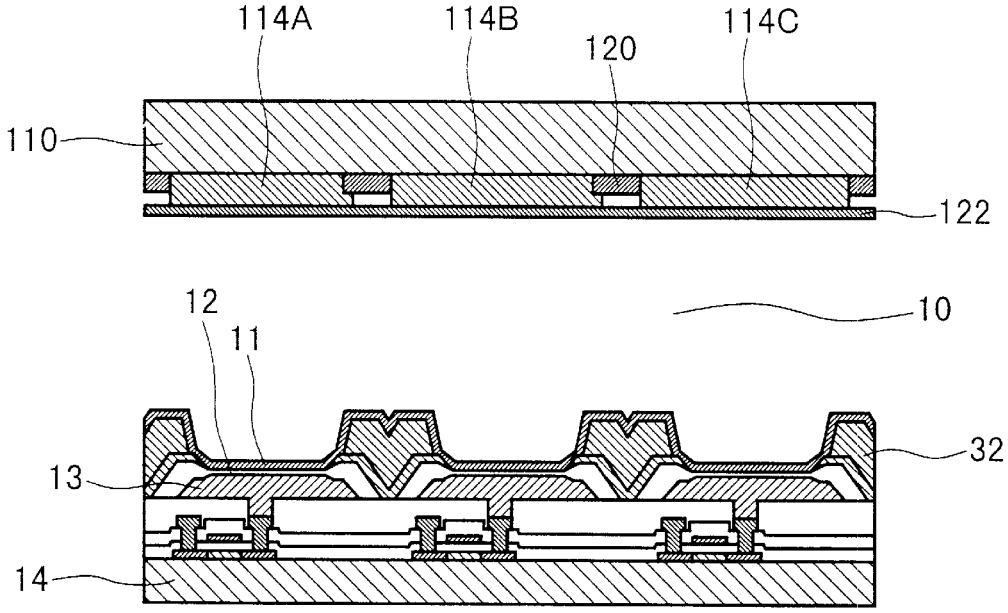
FIGS. 9A and 9B are each a diagram showing a cross section of main components composing the display panel provided by the first embodiment of the present invention.
Figure 9B:
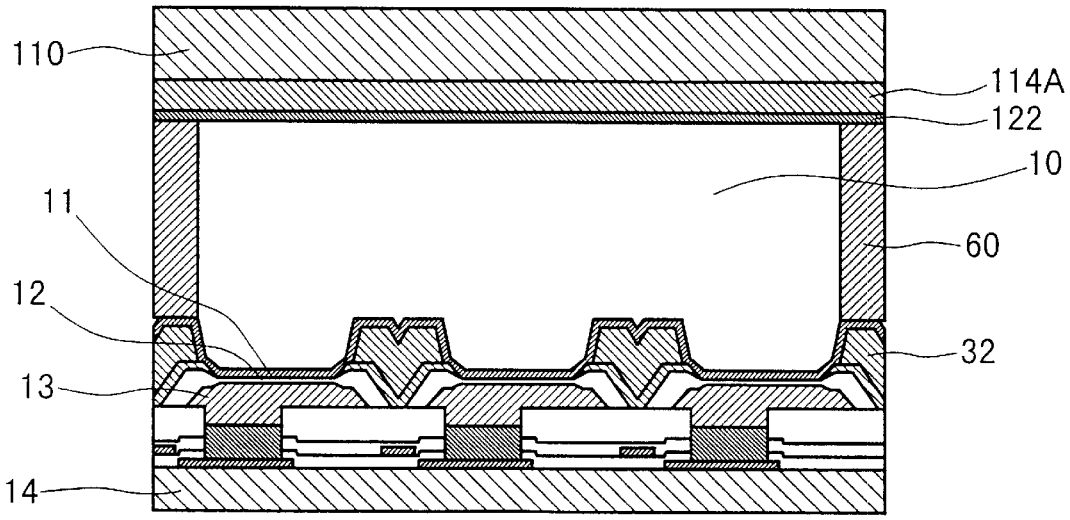

FIGS. 9A and 9B are each a diagram showing a cross section of main components composing the display panel provided by this embodiment. To be more specific, FIG. 9A is a diagram showing a cross section of main components along a crossing line IXA—IXA shown in FIGS. 7 and 8 while FIG. 9B is a diagram showing a cross section of main components along a crossing line IXB—IXB shown in FIGS. 7 and 8.

It should be noted, however, that FIGS. 7 and 8 do not show the substrate 14.

The phosphor plate provided by this embodiment has a black matrix 120 formed on a substrate 110 made of typically sodalime glass, red (R) phosphors 114A, green (G) phosphors 114B, blue (B) phosphors 114C and a metal back film 122 formed on the red (R) phosphors 114A, the green (G) phosphors 114B and the blue (B) phosphors 114C. The red (R) phosphors 114A, the green (G) phosphors 114B and the blue (B) phosphors 114C are formed in grooves of the black matrix 120.

Next, a method of forming the phosphor plate provided by this embodiment is explained.

First of all, a black matrix 120 for improving the contrast of the display apparatus is formed on the substrate 110. Refer to FIG. 9A.

The black matrix 120 is provided between red, green and blue phosphors 114A to 114C on the display panel shown in FIG. 7. However, FIG. 7 does not show the black matrix 120.

Next, red (R) phosphors 114A, green (G) phosphors 114B and blue (B) phosphors 114C are formed.

The patterning of the red (R) phosphors 114A, the green (G) phosphors 114B and the blue (B) phosphors 114C is carried out by using a photolithography method in the same way as those used on the fluorescent screen of an ordinary cathode-ray tube.

The red phosphors 114A may be made of $Y_2O_2S$:Eu (P22-R) and the green phosphors 114B may be made of Zn2$SiO_4$:Mn (P1-G1) The blue phosphors 114C may be made of ZnS:Ag (P22-B).

Then, after a filming process with a film made of typically nitrocellulose, a metal back film 122 is formed by deposition of Al at a film thickness in the range 50 to 300 nm over the entire substrate 110.

Later on, the substrate 110 is heated to a temperature of about 400 degrees Celsius in order to thermally dissolve organic substances such as the filming film. By carrying out the processes described above, the phosphor plate is completed.

The electron-emitter plate and the phosphor plate fabricated as described above are separated away from each other by a spacer 60 and sealed by using frit glass.

Positional relations between the substrate 14 and the red (R) phosphors 114A, the green (G) phosphors 114B and the blue (B) phosphors 114C, which are formed on the substrate 110, are shown in FIG. 7.

As is obvious from FIGS. 9A and 9B, if the substrate 14 is seen from a position above the substrate 14, a top view of the substrate 14 will show that the entire surface of the substrate 14 is covered by the top electrode 11.

FIG. 8 is a diagram showing a pattern of thin-film electron emitter elements 301 formed on the substrate 14 by associating elements shown in the figure with their respective ones shown in FIG. 7. It should be noted that, in order to explicitly depict positional relations shown in FIG. 7, the diagram of FIG. 8 includes the electron emission region 18.

Enclosed by the protection insulator 15, the electron emission region 18 is a region for actually emitting electrons.

The phosphors 114 are located right above the electron emission region 18.

Considering that an emitted electron beam is spread to a certain degree, we set the width of the electron emission region 18 at a value smaller than the width of the phosphors 114.

The distance between the substrate 110 and the substrate 114 is set at about 1 to 3 mm.

The spacer 60 is inserted in order to prevent the panel from being damaged by an external force, which is applied under the atmospheric pressure when the inside of the panel becomes a vacuum.

If a display apparatus with a display area having dimensions not exceeding a width of 4 cm and a length of 9 cm is made by using glass with a thickness of 3 mm as a material for forming the substrates 14 and 110, the mechanical and physical strengths of the substrates 14 and 110 themselves will be big enough for withstanding the atmospheric pressure. In this case, it is thus unnecessary to insert the spacer 60.

The spacer 60 has typically a sheet shape like one shown in FIG. 7.

In this embodiment, supports of the spacer 60 are provided at intervals of 3 rows. However, the number of such supports or the support density may be decreased as long as the mechanical and physical strength is in a range big enough for withstanding the atmospheric pressure.

The spacer 60 may be made of glass or a ceramic material, and comprises supports, which each have a sheet shape or a pillar like shape and are placed at predetermined intervals.

Air inside the seal-bonded panel is exhausted to a vacuum of about $1\times10^{-7}$ Torrs and the panel is then subjected to a seal-packaging process. Subsequently, at a predetermined position inside the panel, a getter film is formed or a getter material is activated. It should be noted that the predetermined position itself is not shown in the figure.

In the case of a getter material with barium (Ba) serving as a main component thereof, for example, a getter film can be formed by RF-induction heating. By carrying out the processes described above, the display panel provided by this embodiment is completed.

Since the distance between the substrate 110 and the substrate 114 is set at a large value in the range 1 to 3 mm, a high acceleration voltage in the range 3 to 6 KV may be applied to the metal back film 122.

Thus, phosphors for a cathode-ray tube (CRT) can be used as the red (R) phosphors 114A, the green (G) phosphors 114B and the blue (B) phosphors 114C as described above.

Figure 10:
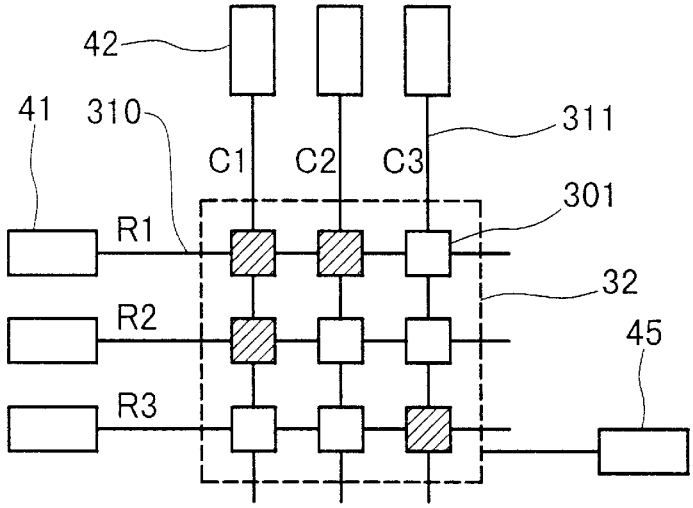
FIG. 10 is an interconnection diagram showing the display panel provided by the first embodiment of the present invention with a variety of drivers connected to the panel provided by the first embodiment.

FIG. 10 is an interconnection diagram showing the display panel provided by this embodiment with driving circuitry connected to the panel.

As shown in the figure, the row electrodes 310 are each connected to a row-electrode driver 41 and the column electrodes 311 are each connected to a column-electrode driver 42. The top-electrode bus-line 32 common to all pixels is connected to a top-electrode driver 45.

The row-electrode driver 41 and the column-electrode driver 42 may be connected to the electron-emitter plate by typically pressing a tape-carrier package with an anisotropically-conducting film. As an alternative, an chip-on-glass is used for directly mounting IC chips composing the row-electrode driver 41 and the column-electrode driver 42 on the substrate 14 of the electron-emitter plate.

It should be noted that an acceleration voltage in the range 3 to 6 KV generated by an acceleration-voltage source is applied to the metal back film 122 at normal times. The application of such an acceleration voltage is not shown explicitly in the figure though.

While FIG. 10 shows only 3 rows and 3 columns, an actual display apparatus has a matrix having hundreds rows and thousands columns. It is thus needless to say that FIG. 10 shows only a portion of the matrix.

Figure 11:
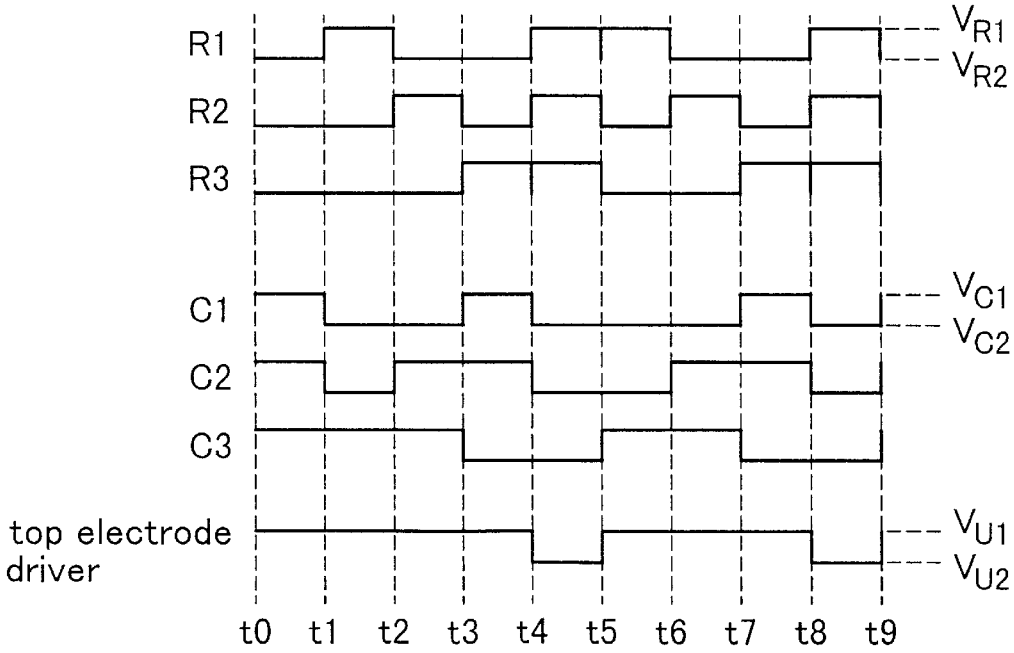
FIG. 11 shows a timing chart of typical waveforms of voltages output by the drivers shown in FIG. 10.

FIG. 11 shows a timing chart of typical waveforms of voltages output by the row-electrode drivers 41, the column-electrode drivers 42 and the top-electrode driver 45, which are shown in FIG. 10.

In the figure, a symbol Rn denotes a row electrode 310 on the nth row, a symbol Cm denotes a column electrode 311 on the mth column and a notation (n, m) denotes a dot at the intersection of the row electrode 310 on the nth row and the column electrode 311 on the mth column.

At a time t1, a voltage $V_{R1}$ of 15 V is applied to the R1 row electrode 310. On the other hand, a voltage $V_{c2}$ of 0 V is applied to the C1 column electrode 311 and the C2 column electrode 311, while a voltage $V_{c1}$ of 10 V is applied to the C3 column electrode 311.

The top-electrode driver 45 outputs a voltage $V_{u1}$ of 10 V.

In this case, the gate voltage of any pixel transistor 302, the gate of which is connected to the R1 row electrode 310, is 15 V. Thus, such pixel transistors 302 are each put in a conducting state.

As a result, a voltage of 10 V ($=V_{u1}-V_{c2}$) is applied between the top electrode 11 and the base electrode 13 at dots (1, 1) and (1, 2). Since the magnitude of this voltage ($V_{u1}-V_{c2}=10$ V) is set higher than an electron-emission start voltage, electrons are emitted from the thin-film electron emitter elements 301 at the dots (1, 1) and (1, 2) to the vacuum 10.

After the emitted electrons are accelerated by a voltage applied to the metal back film 112, the electrons collide with the red (R) phosphors 114A, the green (G) phosphors 114B and the blue (B) phosphors 114C, causing the red (R) phosphors 114A, the green (G) phosphors 114B and the blue (B) phosphors 114C to emit lights.

On the other hand, a voltage of 0 V ($=V_{u1}-V_{c1}$) is applied between the top electrode 11 and the base electrode 13 at a dot (1, 3). Thus, no electrons are emitted from the thin-film electron emitter element 301 at the dot (1, 3) to the vacuum 10.

At a time t2, the voltage $V_{R1}$ of 15 V is applied to the R2 row electrode 310. On the other hand, a voltage $V_{c2}$ of 0 V is applied to the C1 column electrode 311. In this case, a dot (2, 1) is turned on.

As voltages with the waveforms shown in FIG. 11 are applied to the row electrodes 310 as described above, the column electrodes 311 and the top-electrode bus-lines 32 as described above, hatched dots only are turned on as shown in FIG. 10.

In this way, by varying the signals applied to the column electrodes 311, a desired image or desired information contents can be displayed. In addition, by properly adjusting the levels of the voltages applied to the column electrodes 311 in the range $V_{c1}$ to $V_{c2}$ in accordance with an image signal, a picture with a gray-scale can be displayed.

At a time t4, the voltage $V_{R1}$ is applied to all row electrodes 310 to put all pixel transistors 302 in a conducting state, and the voltage $V_{c2}$ to all column electrodes 311.

In this state, assume that a voltage $V_{u2}$ of −5 V is generated by the top-electrode driver 45. Thus, a voltage of −5 V ($=V_{u2}-V_{c2}$) is applied to all dots. By applying a voltage with an opposite polarity (or a reverse pulse) in this way, the life of each thin-film electron emitter element 301 can be prolonged. In addition, by providing a function to apply a reverse pulse to the top-electrode driver 45, the configuration of the column-electrode driver 42 can be made simple. Since a large number of column-electrode drivers 42 are employed, simplification of the configuration of the column-electrode driver 42 is extremely effective for cost reduction. In the example shown in FIG. 11, a reverse pulse is applied during periods t4 to t5 and t8 to t9. If the periods t4 to t5 and t8 to t9 are each set in a vertical blanking period of the video signal, good matching with the video signal can be obtained.

In accordance with the description given so far, a thin-film transistor (TFT) made of poly-Si is employed as a pixel transistor 302. It should be noted that a thin-film transistor made of a-Si can of course be used to give the same effects.

If a thin-film transistor made of a-Si is used, however, it is necessary to prevent the thin-film transistor made of a-Si from deteriorating by using a low-temperature sealing process in the seal-packaging process of the substrates 110 and 14.

Figure 12:
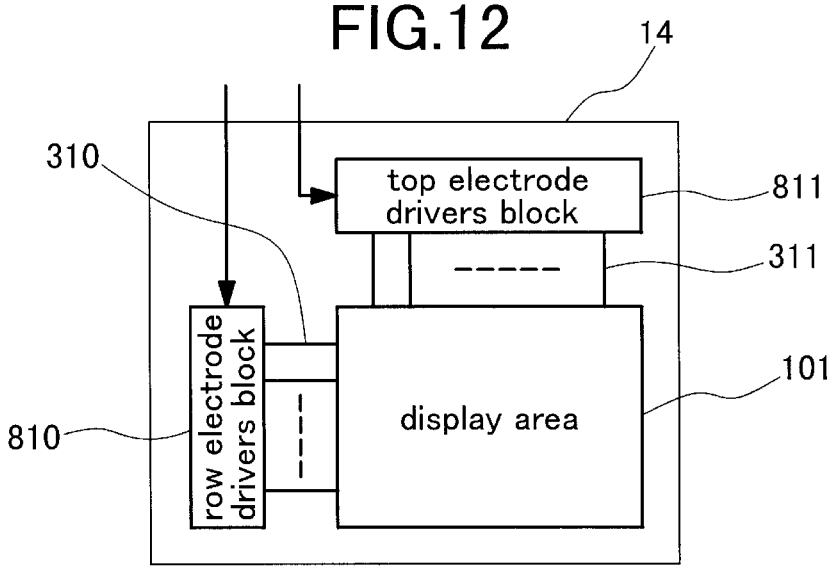
FIG. 12 is a block diagram showing an example of forming driving circuitry on the electron-emitter plate of the display panel provided by the first embodiment of the present invention.

With a poly-Si thin-film transistor used, it is possible to form the drivers, namely, the row-electrode driver 41, the column-electrode driver 42 and the top-electrode driver 45 also on the substrate 14. In this case, a typical configuration like one shown in FIG. 12 is built on the substrate 14. As shown in FIG. 12, the configuration built on the substrate 14 has a display area 101, a row-electrode driver block 810 and a column-electrode driver block 811.

In the display area 101, a pixel transistor 302 and a thin-film electron emitter element 301 are formed at each intersection of a row electrode 310 and a column electrode 311. In the row-electrode driver block 810, row-electrode drivers 41 each connected to a row electrode 310 and logic circuitry including shift registers are formed. In the column-electrode driver block 811, on the other hand, column-electrode drivers 42 each connected to a column electrode 311 and logic circuitry including serial-parallel conversion circuitry are formed.

In such a configuration, serial-parallel conversion is carried out in the row-electrode driver block 810 and the column-electrode driver block 811. Thus, the number of lines for receiving signals from a source outside the substrate 14 can be reduced considerably, allowing the implementation cost to be decreased as well.

Second Embodiment

The display apparatus implemented by a second embodiment of the present invention employs the same display panel as the first embodiment. The second embodiment is different from the first one in that, in the case of the former, the column-electrode driver 42 has a constant-current circuit.

Figure 13:
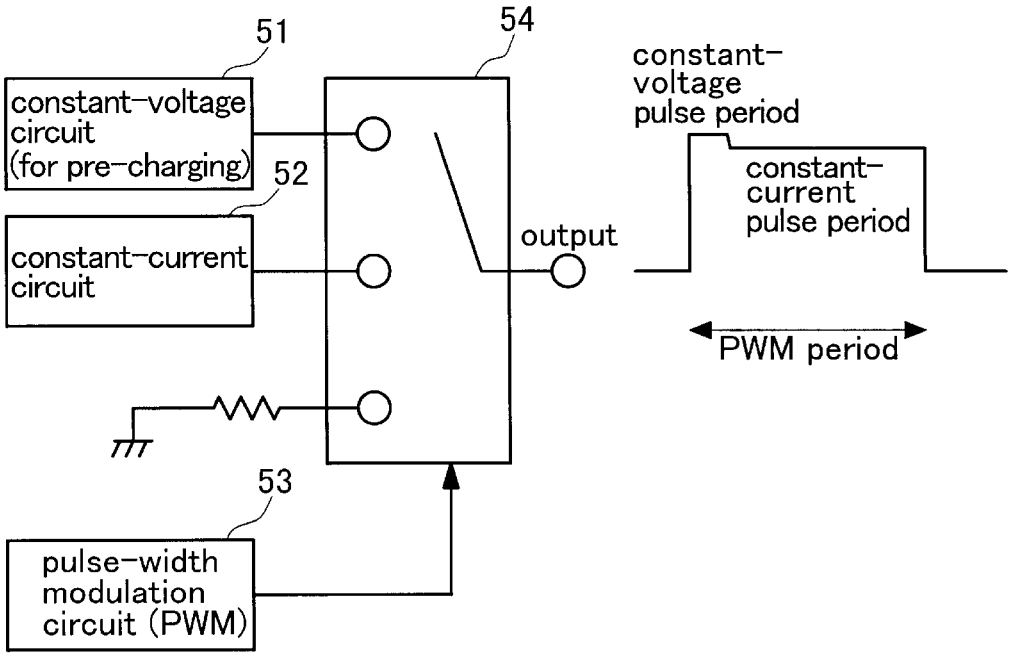
FIG. 13 is a block diagram showing a typical internal configuration of a column-electrode driver provided by a second embodiment of the present invention in a simple and plain manner.

FIG. 13 is a block diagram showing a typical internal configuration of the column-electrode driver 42 provided by the second embodiment in a simple and plain manner. As shown in FIG. 13, the column-electrode driver 42 has a constant-voltage circuit 51, a constant-current circuit 52, a pulse-width-modulation (PWM) circuit 53 and a switching circuit 54.

Figure 14:
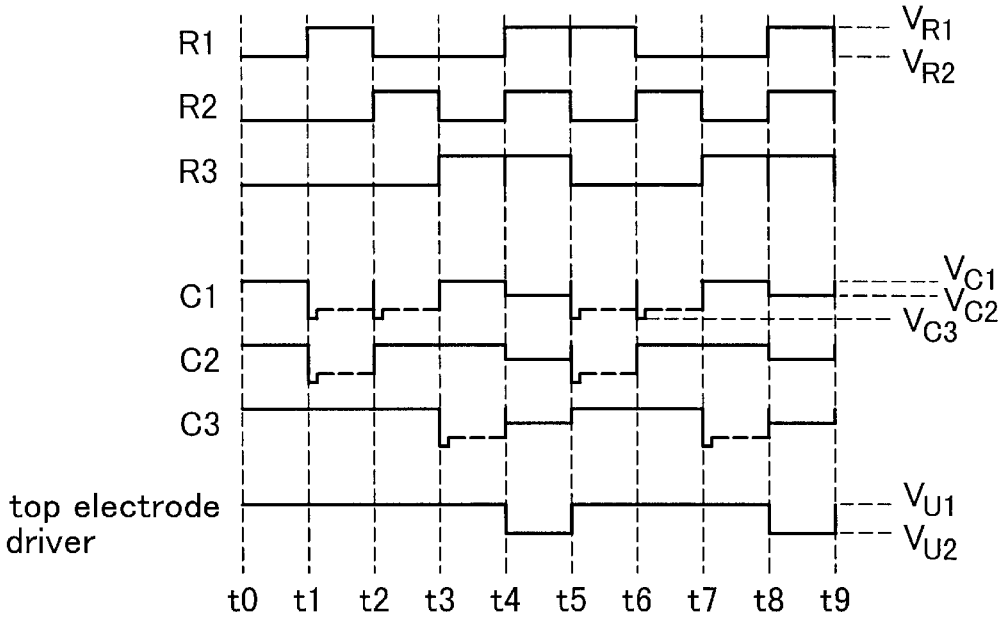
FIG. 14 shows a timing chart of typical waveforms of driving voltages generated by a variety of drivers in the display apparatus implemented by the second embodiment of the present invention.

FIG. 14 shows a timing chart of typical waveforms of driving voltages generated by the drivers, namely, the row-electrode driver 41, the column-electrode driver 42 and the top-electrode driver 45, in the display apparatus implemented by the second embodiment of the present invention.

It should be noted that, in this embodiment, an acceleration voltage in the range 3 to 6 KV generated by an acceleration-voltage generator is applied to the metal back film 122 at normal times. The application of such an acceleration voltage is not shown in the figure though.

Much like the first embodiment, a symbol Rn denotes a row electrode 310 on the nth row, a symbol Cm denotes a column electrode 311 on the mth column and a notation (n, m) denotes a dot at the intersection of the row electrode 310 on the nth row and the column electrode 311 on the mth column.

It should be noted that portions each represented by a dotted line in the driving waveforms shown in FIG. 14 each correspond to a period during which a constant current is output.

At a time t1, a voltage $V_{R1}$ is applied to an R1 row electrode 310 to put each pixel transistor 302, the gate of which is connected to the R1 row electrode 310, in a conducting state. Then, a constant voltage $V_{c3}$ generated by the constant-voltage circuit 51 is applied to C1 and C2 column electrodes 311 by way of the switching circuit 54 for a short period of time. Subsequently, the switching circuit 54 is changed over to the constant-current circuit 52 for generating a constant-current output for a predetermined period of time.

At the end of the predetermined period of the constant-current pulse, connection to the ground potential (the earth potential) through a resistor is made. It should be noted that, while the ground potential is used in this embodiment, another potential can also be selected provided that the electron emission operation carried out by the electron emitter is in a halt state.

Since the constant voltage $V_{c3}$ is applied to electrically charge a stray capacitance of the column electrode 311, the period of the application of the constant voltage is set at a value large enough for electrically charging the stray capacitance. In this embodiment, the period is set at 4 $\mu$s.

Conductive pixel transistors 302 with the gate thereof connected to the R1 row electrode 310 apply a driving voltage generated by the column-electrode driver 42 to a thin-film electron emitter element 301 associated with the pixel transistor 302, causing the thin-film electron emitter element 301 to emit electrons during a period t1 to t2, which is set at 64 $\mu$s in the case of this embodiment. Thus, the amount of electron emission is determined mostly by the current output during the constant-current period. Since the brightness of light emitted by a fluorescent screen is proportional to the amount of electron emission, the brightness can be set by the constant current output by the column-electrode driver 42.

Accordingly, this method is particularly effective for a case in which there are variations in brightness-voltage characteristic, that is, variations in emission-current-versus-voltage characteristic.

In addition, the voltage $V_{c3}$ applied during the period of constant-voltage application is all but equal to or higher than a voltage applied during the constant-current period. It should be noted that, if the stray capacitance is so small that desired electron emission can be achieved only by the constant-current output within a short period of time, the period for applying the constant voltage is not required.

By the same token, the emission of electrons by pixels associated with the R2 row electrode 310 and the subsequent row electrodes 310, that is, the brightness of light emitted by the fluorescent screen, is controlled by the constant currents output by the column-electrode driver 42.

As a result, pixels each represented by a hatched block in FIG. 10 emit electrons.

In this way, any picture can be displayed.

In addition, by controlling the period of the constant-current output by means of the PWM circuit 53, a picture with a gray scale can be displayed. As an alternative to the pulse-width modulation, the magnitude of the constant current output by the constant-current circuit 52 can be varied in accordance with a gray scale to display a picture with the gray scale. As another alternative, both the pulse-width modulation is carried out and the magnitude of the constant current is modulated to display a picture with a gray scale.

During periods t4 to t5 and t8 to t9, a constant voltage $V_{c2}$ is supplied to all column electrodes 311 to apply reverse pulses.

As described above, each pixel in this embodiment has a combination of a thin-film electron emitter element 301 and a pixel transistor 302 and the column-electrode driver 42 employs a constant-current circuit 52. Thus, not only can the effect of variations in characteristic from transistor to transistor on the displayed picture be reduced to improve the display quality, but the allowance of the variations in characteristic from transistor to transistor can also be increased substantially, allowing the manufacturing yield to be raised.

Third Embodiment

Figure 15:
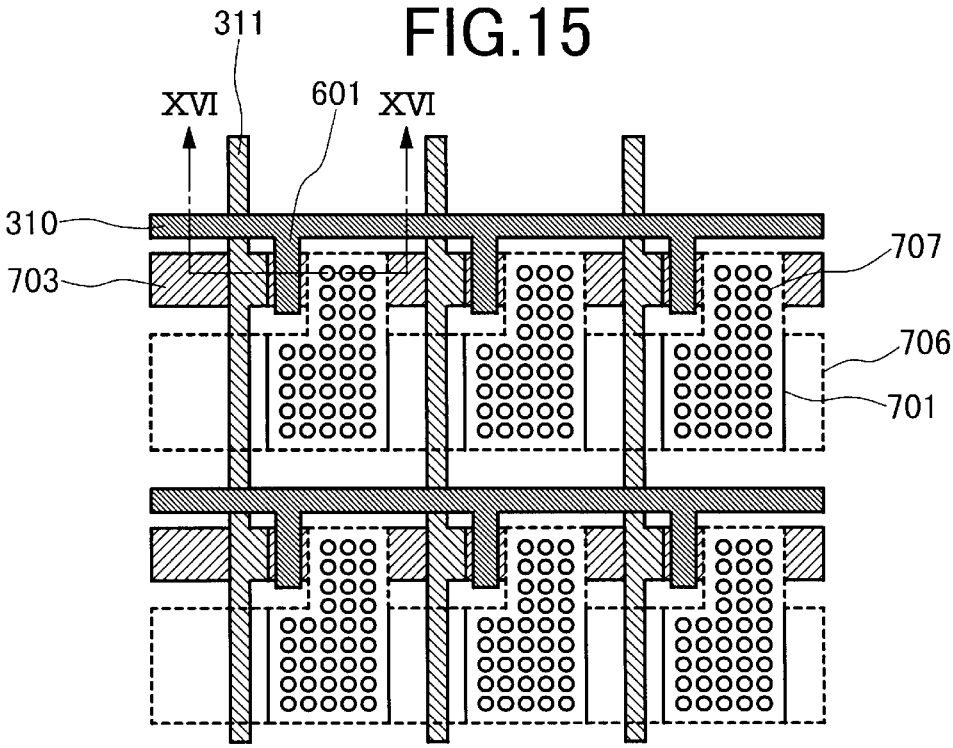
FIG. 15 is a top view of pixel transistors and field-emitter arrays, which are formed on a substrate in a third embodiment of the present invention.
Figure 16:
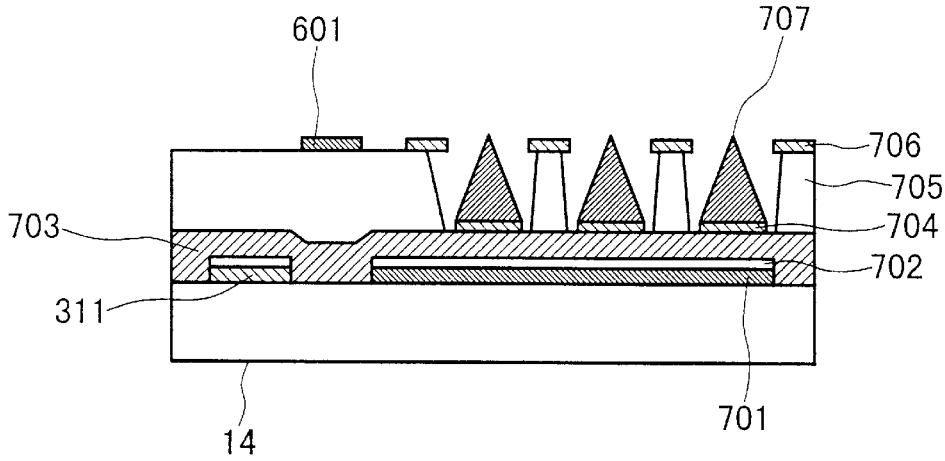
FIG. 16 is a cross-sectional diagram showing a structure of main components composing a field-emitter array in the third embodiment of the present invention.
Figure 17:
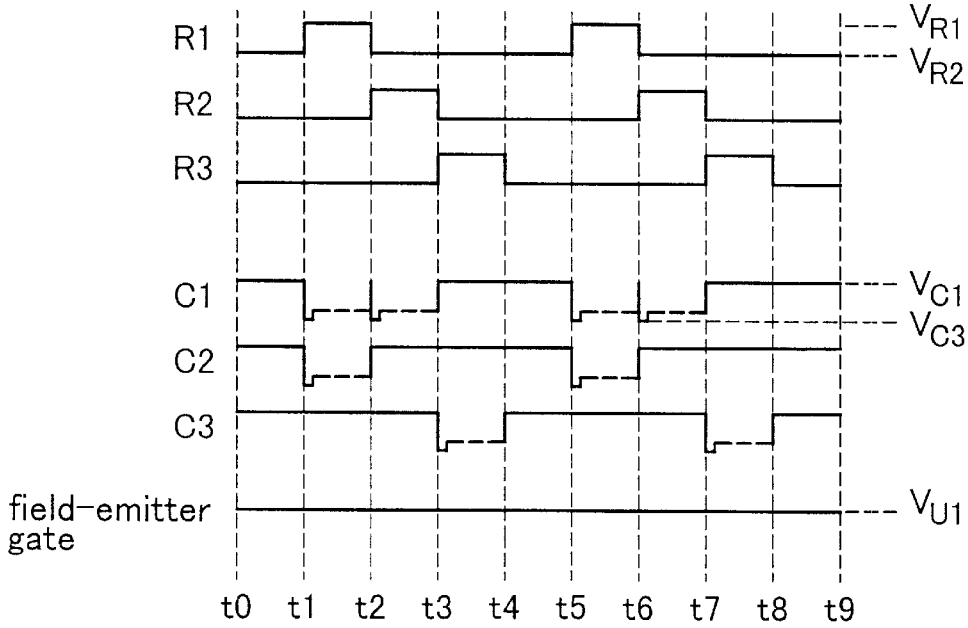
FIG. 17 shows a timing chart of typical waveforms of driving voltages output by a variety of drivers in the display apparatus implemented by the third embodiment of the present invention.

As a third embodiment of the present invention, a display apparatus employing a field-emitter array is explained by referring to FIGS. 15, 16 and 17.

FIG. 15 is a top view of pixel transistors and field-emitter arrays, which are formed on a substrate in this embodiment.

FIG. 16 is a cross-sectional diagram showing a structure of main components composing a field-emitter array in this embodiment along a crossing line XVI—XVI shown in FIG. 15.

The structure of an array provided by this embodiment is explained by referring to FIGS. 15 and 16 as follows.

A column electrode 311 serving also as sources of pixel transistors 302 and an undercoat electrode 701 made of chrome (Cr) are formed on a glass substrate 14.

After a contact layer 702, which is used for providing ohmic contact and made of n+-a-Si, is formed, an a-Si : H layer 703 is formed.

Emitter tips 707 made of a-Si are formed over the a-Si:H layer 703, being each separated from the a-Si:H layer 703 by a chrome (Cr) layer 704.

Insulators 705 made of $SiO_2$ are further formed. Finally, a pixel-transistor gate 601 and a field-emitter gate 706 are formed. The pixel-transistor gate 601 is formed as a part of the row electrode 310.

In the top view of FIG. 15, the field-emitter gate 706 is indicated as dashed lines.

The field-emitter gate 706 is a component common to all pixels in the electron-emitter matrix.

Thus, the configuration of the electron-emitter matrix is the same as that shown in FIG. 1 except that the thin-film electron emitter elements 301 of the latter are each replaced with a field-emitter array.

It should be noted that the structure of this embodiment can be fabricated by using typically a fabrication method described in the Proceedings of the 98 International Display Workshops, pages 667 to 670 (1998).

The substrates 14 and 110 are then sealed by making the positions of the electron-emitter elements face the positions of the respective phosphors by means of the fabrication methods explained earlier by referring to FIGS. 7 to 9 to form a display panel. The display panel is then wired to the row-electrode drivers 41, the column-electrode drivers 42 and the top-electrode driver 45 as shown in FIG. 1 except that reference numerals 301, 32 and 45 in FIG. 1 denote a field-emitter array, an field-emitter gate and an field-emitter gate driver respectively in the case of this embodiment. As for reference numeral 706 used in this embodiment, a field-emitter gate is denoted.

FIG. 17 shows a timing chart of typical waveforms of driving voltages output by a variety of drivers, namely, the row-electrode deriver 41, the column-electrode driver 42 and the field-emitter gate driver 45 employed in the display apparatus implemented by the third embodiment of the present invention.

Much like the first embodiment, a symbol Rn denotes a row electrode 310 on the nth row and a symbol Cm denotes a column electrode 311 on the mth column.

At normal times, a voltage $V_{u1}$ is applied to field-emitter gate 706. In this embodiment, the voltage Vu1 is of about 100 V. Thus, when the pixel transistor 302 for controlling the flow of a current is put in a conducting state, the emitter tips 707 emit electrons to the vacuum 10, exciting and causing the phosphors to emit lights.

At a time t1, a voltage $V_{R1}$ of about 60 V is applied to an R1 row electrode 310 to put each pixel transistor 302, the gate of which is connected to the R1 row electrode 310, in a conducting state. At the same time, after the column-electrode driver 42 is outputting a constant voltage $V_{c3}$ for about 4 $\mu$s, the column-electrode driver 42 is switched to operate as a constant-current circuit for outputting a constant current.

Since the period t1 to t2 is about 64 $\mu$s, the amount of electric charge emitted during this period is all but controlled by the constant current.

While noise may be generated in the emission current generated by the field-emitter array and there may be variations 1in emission-current magnitude from pixel to pixel, the magnitude of the emission current is limited by the constant-current circuit employed in the column-electrode driver 42 so that the emission current is stabilized.

In addition, the pixel transistor 302 in this embodiment functions as a switch with a limited resistance and the resistance may vary from transistor to transistor. However, the variations in resistance from transistor to transistor do not have an effect on the magnitude of the emission current.

Thus, not only can the effect of the variations in characteristic from transistor to transistor on the displayed picture be reduced to improve the display quality, but the allowance of the variations in characteristic from transistor to transistor can also be increased substantially, allowing the manufacturing yield to be raised.

It should be noted that, before the column-electrode driver 42 is switched to operate as a constant-current circuit for outputting a constant current, the column-electrode driver 42 is outputting a constant voltage Vc3 for a short period of about 4 $\mu$s as described earlier in order to electrically charge the stray capacitance of the column electrode 311 at a high speed. Thus, if the stray capacitance is so small that desired electron emission can be achieved only by the constant-current output within a short period of time, the period for applying the voltage Vc3 is not required.

By the same token, the emission of electrons by pixels associated with the R2 row electrode 310 and the subsequent row electrodes 310, that is, the brightness of light emitted by the fluorescent screen, is controlled by the constant currents output by the column-electrode column-electrode drivers 42.

As a result, pixels each represented by a hatched block in FIG. 10 emit electrons.

In this way, any picture can be displayed.

Even though this embodiment employs a field-emitter array as described above, surface-conduction emitters may also be used to give the same effects. It is particularly obvious that a uniform picture can be obtained even if pixel transistors exhibiting variations in characteristic are employed.

A typical method of fabricating surface-conduction emitters is described in the Journal of the Society of Information Display, Vol. 5, No. 4 (an 1997 issue), pages 345 to 348.

Fourth Embodiment

Figure 18:
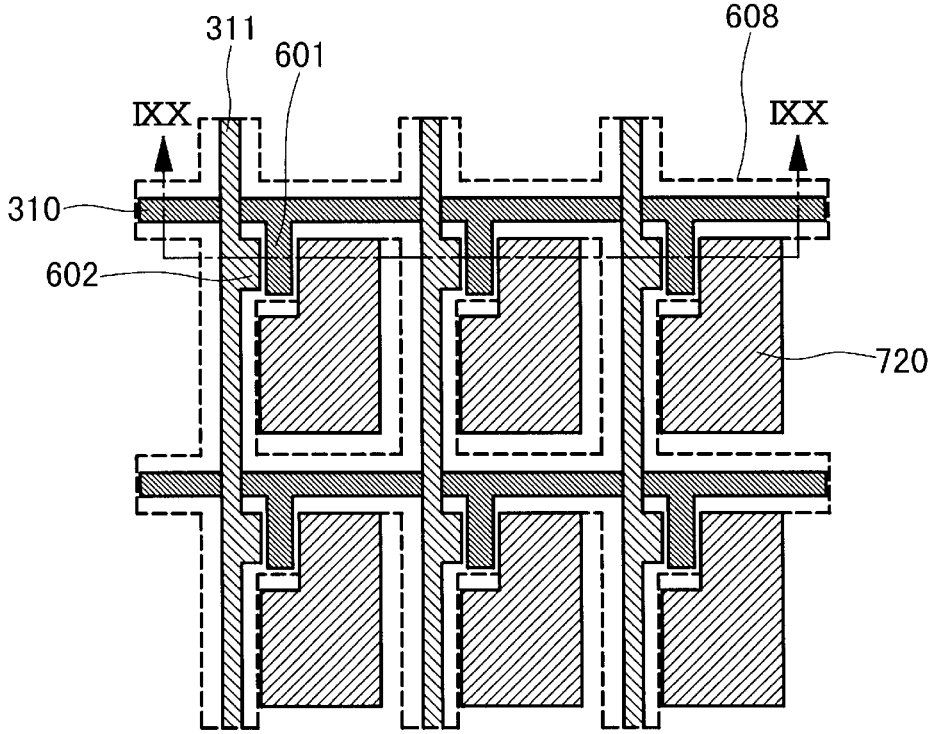
FIG. 18 is a top view of a display apparatus provided by a fourth embodiment of the present invention.
Figure 19:
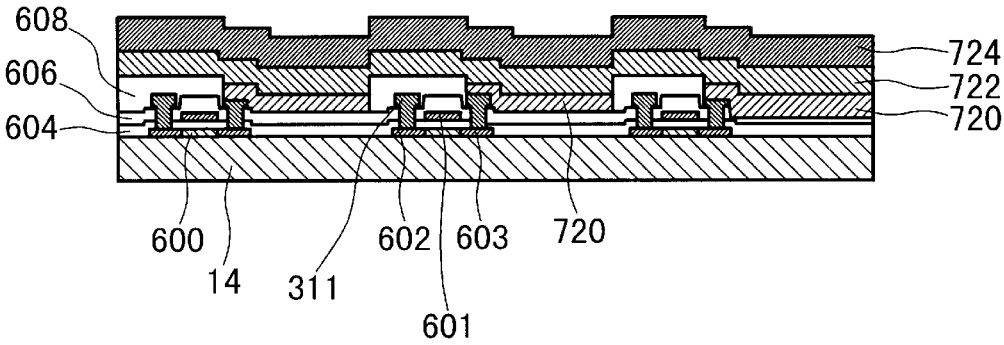
FIG. 19 is a cross-sectional diagram showing a structure of main components composing the display apparatus provided by the fourth embodiment of the present invention.
Figure 20:
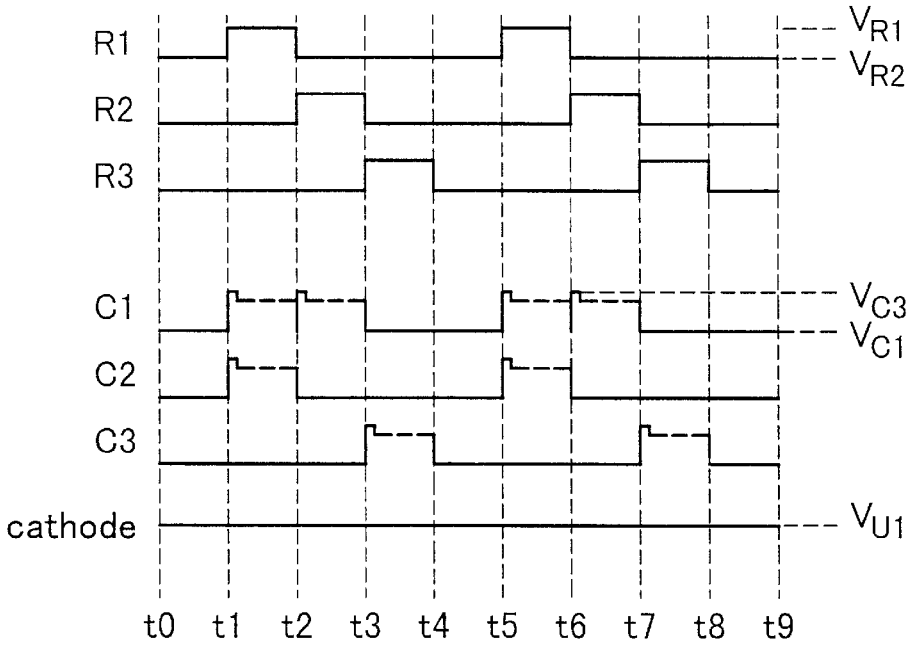
FIG. 20 shows a timing chart of typical waveforms of driving voltages output by a variety of drivers in the display apparatus implemented by the fourth embodiment of the present invention.
Figure 21:
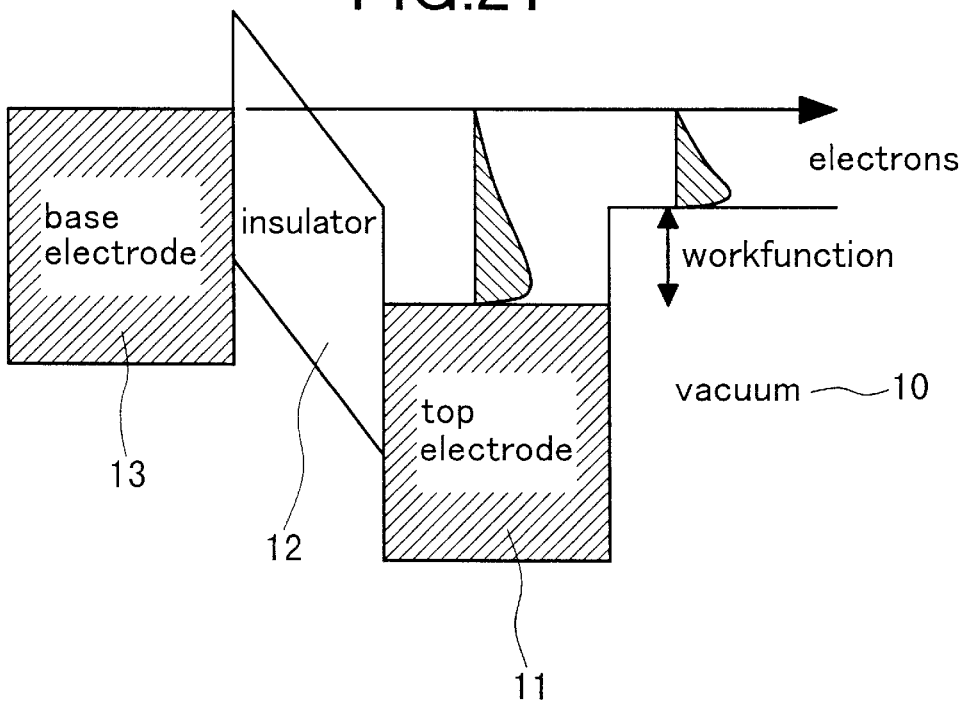
FIG. 21 is an explanatory diagram used for describing the principle of operation of an MIM-type electron emitter.
Figure 22:
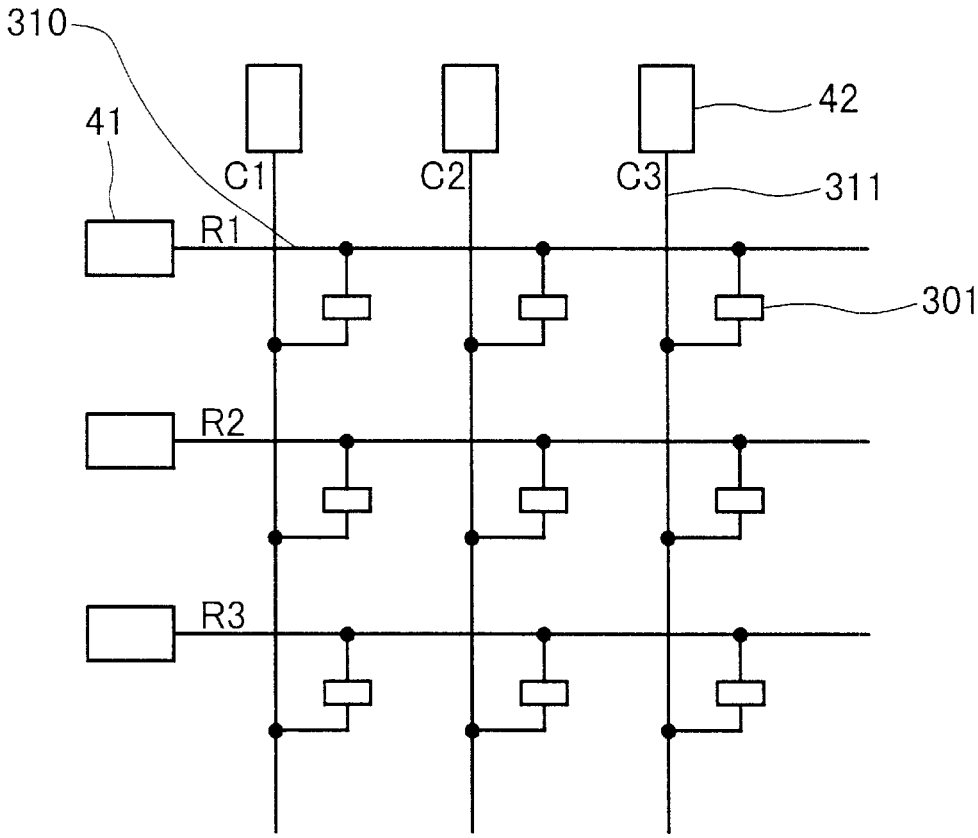
FIG. 22 is a diagram showing the configuration of the conventional matrix of thin-film electron emitters in a simple and plain manner.

As a fourth embodiment of the present invention, a display apparatus employing organic electro-luminescent elements, which are also called organic light-emitting diodes, are explained by referring to FIGS. 18, 19 and 20.

FIG. 18 is a top view of a display apparatus provided by the fourth embodiment.

FIG. 19 is a cross-sectional diagram showing a structure of main components composing the display apparatus provided by this embodiment along a crossing line IXX—IXX shown in FIG. 18.

The structure of the display apparatus provided by this embodiment is explained by referring to FIGS. 18 and 19 as follows.

On a transparent substrate 14 made of typically a non-alkali glass, a thin-film transistor is formed. As shown in FIG. 19, the thin-film transistor has a source 602, a drain 603, a poly-Si film 600, a gate insulator 604 and a gate 601.

The gate 601 is connected to the row electrode 310 whereas the source 602 is connected to the column electrode 311. The row electrode 310 is insulated from the column electrode 311 by an inter-layer insulator 606.

The thin-film transistor is covered by a passivation film 608, which is shown as a pattern enclosed by a dashed line in FIG. 18. As is obvious from the pattern, the passivation film 608 also covers the row electrodes 310 and the column electrodes 311.

The structures described above can be formed by using the same fabrication methods as the first embodiment.

The drain 603 is connected to an anode 720 by a connection electrode 607. The anode 720 is a transparent electrode made of typically an ITO film which is an Sn-doped indium oxide film.

A light-emission layer 722 is formed on the entire surface of the anode 720. The light-emission layer 722 is formed by stacking a hole-injection layer, a hole-transport layer, a light-emission layer and an electron-transport layer on each other from the anode side in an order the hole-injection layer, the hole-transport layer, the light-emission layer and the electron-transport layer are enumerated. Compositions of the materials are described in documents such as the 1997 SID International Symposium Digest of Technical Papers, pages 1073 to 1076 (May 1997).

As an alternative light-emission layer 722, it is also possible to use a polymer-type light-emission layer described in the 1999 SID International Symposium Digest of Technical Papers, pages 372 to 375 (May 1999).

Then, a cathode 724 is formed on the entire surface of light-emission layer 722.

Finally, the entire matrix is covered by a protection layer, which is not shown in FIGS. 18 and 19 to prevent moist air from penetrating into the device.

As described above, the anode 720 of the organic EL element at each pixel is connected to the drain 603 of the pixel transistor 302 for the pixel while the cathode 724 serves as an electrode common to all pixels.

Thus, the circuit configuration of the matrix is the same as the first embodiment shown in FIG. 1 except that reference numerals 301, 32 and 45 in FIG. 1 denote an organic EL element, the anode 724 and an anode driver respectively in the case of this fourth embodiment.

FIG. 20 shows a timing chart of typical waveforms of driving voltages output by a variety of drivers, namely, the row-electrode driver 41, the column-electrode drivers 42 and the anode driver 45 employed in the display apparatus implemented by the fourth embodiment of the present invention.

Much like the first embodiment, a symbol Rn denotes a row electrode 310 on the nth row and a symbol Cm denotes a column electrode 311 on the mth column.

At normal times, a voltage $V_{a1}$ is applied to the anode 724. In this embodiment, the voltage $V_{a1}$ is 0 V.

At a time t1, a voltage $V_{R1}$ of about 15 V is applied to an R1 row electrode 310 to put each pixel transistor 302, the gate of which is connected to the Rc row electrode 310, in a conducting state. At the same time, after the column-electrode driver 42 is outputting a constant voltage $V_{c3}$ for about 4 $\mu$s where $V_{c3}>V_{a1}$, the column-electrode driver 42 is switched to operate as a constant-current circuit for outputting a constant current.

As a result, a current flows from the anode 720 of the organic EL element to the cathode 724 thereof, causing the light-emission layer 722 to emit lights.

Since the period t1 to t2 is about 64 $\mu$s, the amount of electric charge flowing through the organic EL element during this period is all but controlled by the magnitude of the constant-current output.

The voltage-brightness characteristic of an organic EL element may vary from pixel to pixel. Since a constant-current circuit employed in the column-electrode driver 42 controls the magnitude of the injection current to a constant value, however, the brightness is also determined by a set value of the constant-current circuit. As a result, the problem caused the variations in voltage-brightness characteristic is solved.

In addition, the pixel transistor 302 in this embodiment functions as a switch with a limited resistance and the resistance may vary from transistor to transistor. However, the variations in resistance from transistor to transistor do not have an effect on the magnitude of the light-emission.

It should be noted that, before the column-electrode driver 42 is switched to operate as a constant-current circuit for outputting a constant current, the column-electrode driver 42 is outputting a constant voltage $V_{c3}$ for a short period of about 4 $\mu$s as described earlier in order to electrically charge the stray capacitance of the column electrode 311 at a high speed. Thus, if the stray capacitance is so small that desired light emission can be achieved only by the constant-current output within a short period of time, the period for applying the voltage $V_{c3}$ is not required.

By the same token, the emission of light by pixels associated with the R2 row electrode 310 and the subsequent row electrodes 310, is controlled by the constant currents output by the column-electrode drivers 42.

As a result, pixels each represented by a hatched block in FIG. 10 emit light. In this way, any picture can be displayed.

In comparison with the conventional display apparatus employing no pixel transistors, the display apparatus employing organic EL elements and pixel transistors 302 as implemented by this embodiment described above has the following merits.

In the conventional display apparatus, currents of all the organic EL elements which are connected to a selected row electrode 310 flow to the selected row electrode 310. Thus, the wire resistance must be sufficiently reduced. In the case of this embodiment, however, flows of currents are not concentrated on a row electrode 310. Thus, the display apparatus is relieved from a requirement to reduce the wire resistance.

To put it in more detail, the currents used to be concentrated on a row electrode 310 in the conventional display apparatus now flow through the cathode 724 in this embodiment. Since the cathode 724 is a component common to all pixels, however, the currents are distributed throughout the cathode 724.

In addition, since the cathode 724 is a component common to all pixels, the patterning of the cathode 724 is not required. As a result, the fabrication is easy to carry out.

Moreover, variations in current-voltage characteristic from EL element to EL element in this embodiment are tolerable as described above.

Furthermore, not only can the effect of the variations in characteristic from transistor to transistor on the displayed picture be reduced to improve the display quality, but the allowance of the variations in characteristic from transistor to transistor can also be increased substantially, allowing the manufacturing yield to be raised.

By the way, the display apparatus employing combinations of organic EL elements and pixel transistors, with which a constant-current circuit is implemented, is described in the documents such as the 1999 SID International Symposium Digest of Technical Papers, pages 438 to 441 (May 1999).

In the display apparatus described in this reference, 4 transistors are required for each pixel. In the case of this embodiment, on the other hand, only 1 transistor per pixel is required, making the display apparatus easy to make.

There has also been proposed a technique with a configuration of 2 transistors per pixel to implement a constant-current circuit per pixel. In accordance with this technique, however, a constant-current characteristic in the saturation region of the transistor is used. Thus, the effect of the variations in characteristic from transistor to transistor is big as described earlier. As a result, the fabrication of the display apparatus is difficult.

It should be noted that, by using a light-emitting diode in place of the organic EL element in the same configuration as that shown in FIG. 1, the same effects as this embodiment can of course be obtained.

The present invention has been exemplified in concrete terms by preferred embodiments. It should be noted, however, that the scope of the present invention is not limited to the embodiments. As will be apparent, a variety of changes and modifications can be made to the embodiments without departing from the essence of the present invention.

Representative effects of the present invention disclosed in this specification are explained briefly as follows:

1: The present invention allows the power consumption of a display apparatus to be reduced.

2: In accordance with the present invention, the effect of variations in characteristic from transistor to transistor on the displayed picture can be reduced to improve the display quality.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A display apparatus comprising a display element, said display element comprising a first substrate, and a second substrate having phosphors;

said first substrate having disposed thereon a plurality of transistor elements, a plurality of thin-film electron emitter elements, a plurality of first signal lines extending in a first direction, and a plurality of second signal lines extending in a second direction perpendicular to said first direction;

each of said thin-film electron emitter elements being provided for one of said transistor elements, having a structure comprising a base electrode, an insulator and a top electrode stacked as layers placed one on another in this order of enumeration, and emitting electrons when a positive-polarity voltage is applied to said top electrode;

wherein one of said transistor elements and one of said thin-film electron emitter elements are provided in each intersection region of said plurality of first signal lines and said plurality of second signal lines.

2. A display apparatus comprising a display element, said display element comprising a first substrate, and a second substrate having phosphors;

said first substrate having disposed thereon a plurality of transistor elements, a plurality of thin-film electron emitter elements, a plurality of first signal lines extending in a first direction, and a plurality of second signal lines extending in a second direction perpendicular to said first direction;

each of said thin-film electron emitter elements being provided for one of said transistor elements, having a structure comprising a base electrode, an insulator and a top electrode stacked as layers placed one on another in this order of enumeration, and emitting electrons when a positive-polarity voltage is applied to said top electrode;

wherein each of said transistor elements is provided in an associated one of plurality of regions enclosed by said plurality of first signal lines and said plurality of second signal lines.

3. A display apparatus comprising a display element, said display element comprising a first substrate, and a second substrate having phosphors;

said first substrate having formed thereon a plurality of transistor elements, a plurality of thin-film electron emitter elements, a plurality of first signal lines extending in a first direction, and a plurality of second signal lines extending in a second direction perpendicular to said first direction;

each of said thin-film electron emitter elements being provided for one of said transistor elements, having a structure comprising a base electrode, an insulator and a top electrode stacked as layers placed one on another in this order of enumeration, and emitting electrons when a positive-polarity voltage is applied to said top electrode;

wherein a control electrode of each of said transistor elements is electrically connected to an associated one of said first signal lines, a first electrode of each of said transistor elements is electrically connected to an associated one of said second signal lines, and a second electrode of each of said transistor elements is electrically connected to said base electrode of said thin-film electron emitter element associated with said transistor element.

4. A display apparatus according to claim 3, wherein said transistor elements are formed on a layer different from a layer on which said thin-film electron emitter elements are formed.

5. A display apparatus according to claim 4, wherein said transistor elements are formed on a layer below said base electrodes of said thin-film electron emitter elements, and each of said transistor elements is formed under said base electrode of said thin-film electron emitter element associated therewith.

6. A display apparatus according to claim 5, wherein a plurality of semiconductor layers are formed on said first substrate, a first insulator is formed on said plurality of semiconductor layers, said control electrodes are formed on said first insulator, said first signal lines are formed on said first insulator, a second insulator is formed on said first insulator, said second signal lines are formed on said second insulator, a third insulator is formed on said second insulator, and said base electrodes are formed on said third insulator;

wherein each of said semiconductor layers has a region of said first electrode and a region of said second electrode;

wherein said connection between said first electrode and said second signal line is made by way of a first contact hole through said fist insulator and said second insulator; and wherein said connection between said second electrode and said base electrode is made by way of a second contact hole through said first insulator, said second insulator and said third insulator.

7. A display apparatus according to claim 3, wherein said top electrode is common to all of said thin-film electron emitter elements.

8. A display apparatus according to claim 3, wherein said display apparatus further comprises a top-electrode bus-line formed on a region other than region on which the thin-film electron emitter elements are formed, and said top electrode covers said top-electrode bus-line.

9. A display apparatus according to claim 7, wherein a reverse pulse voltage is applied to said top electrode.

10. A display apparatus according to claim 3, wherein an output impedance of each of said transistor elements is smaller than a differential resistance in an operation region of one of said thin-film electron emitter elements.

11. A display apparatus according to claim 3, wherein said display apparatus further comprises a first driving system which supplies a driving voltage to each of said first signal lines, and a second driving system which supplies a driving voltage to each of said signal lines; and wherein said second driving system has a constant-current circuit.

12. A display apparatus comprising a display element, a first driving system and a second driving system;

said display element comprising a first substrate, and a second substrate having phosphors;

said first substrate having disposed thereon a plurality of transistor elements, a plurality of electron emitter elements each provided for one of said transistor elements, a plurality of first signal lines extending in a first direction, and a plurality of second signal lines extending in a second direction perpendicular to said first direction;

wherein said first driving system supplies a driving voltage to each of said first signal lines;

said second driving system supplies a driving voltage to each of said second signal lines;

a control electrode of each of said transistor elements is electrically connected to an associated one of said first signal lines, a first electrode of each of said transistor elements is electrically connected to an associated one of said second signal lines, a second electrode of each of said transistor elements is electrically connected to said base electrode of said electron emitter element associated with said transistor element, and said second driving system has a constant-current circuit.

13. A display apparatus according to claim 12, wherein said second signal lines are formed on said first substrate, a plurality of third electrodes are formed on said first substrate, a plurality of semiconductor layers are formed on said first substrate in such a way that said semiconductor layers cover some of said second signal lines and said third electrodes, a first insulator is formed on said second signal lines and said semiconductor layers outside a region on which said electron emitter elements are formed, said control electrodes are formed on said first insulator, and said first signal lines are formed on said first insulator.

14. A display apparatus comprising a display element, a first driving system and a second driving system;

said display element comprising a first substrate;

said first substrate having disposed thereon a plurality of transistor elements, a plurality of electro-luminescence elements each provided for one of said transistor elements, a plurality of first signal lines extending in a first direction, and a plurality of second signal lines extending in a second direction perpendicular to said first direction;

wherein said first driving system supplies a driving voltage to each of said first signal lines, said second driving system supplies a driving voltage to each of said second signal lines, a control electrode of each of said transistor elements is electrically connected to an associated one of said first signal lines, a first electrode of each of said transistor elements is electrically connected to an associated one of said second signal lines, a second electrode of each of said transistor elements is electrically connected to a first electrode of said electro-luminescence element associated with said transistor element, and said second driving system has a constant-current circuit.

15. A display apparatus according to claim 14, wherein said transistor elements are formed on a layer different from a layer on which said electro-luminescence elements are formed.

16. A display apparatus according to claim 15, wherein a plurality of semiconductor layers are formed on said first substrate, a first insulator is formed on said plurality of semiconductor layers, said control electrodes are formed on said first insulator, said first signal lines are formed on said first insulator, a second insulator is formed on said first insulator, said second signal lines are formed on said second insulator, and a first electrode is formed on said second insulator for each of said electro-luminescence elements;

wherein each of said semiconductor layers has a region of said first electrode, a first electrode of each of said transistor elements and a region of said second electrode of said transistor element;

wherein said connection between said first electrode of said transistor element and said second signal line is made by way of a first contact hole through said first insulator and said second insulator; and wherein said connection between said second electrode of said transistor element and said first electrode of said electro-luminescence element is made by way of a second contact hole through said first insulator and said second insulator.

17. A display apparatus according to claim 14, wherein each of said electro-luminescence elements is an organic electro-luminescence element.

18. A display apparatus according to claim 17, wherein a driving method of said display apparatus is a line-at-a-time driving method.

19. A display apparatus comprising a display element, a first driving system and a second driving system;

said display element comprising a first substrate;

said first substrate having disposed thereon a plurality of transistor elements, a plurality of light-emitting diode elements each provided for one of said transistor elements, a plurality of first signal lines extending in a first direction, and a plurality of second signal lines extending in a second direction perpendicular to said first direction;

wherein said first driving system supplies a driving voltage to each of said first signal lines, said second driving system supplies a driving voltage to each of said second signal lines, a control electrode of each of said transistor elements is electrically connected to an associated one of said first signal lines, a first electrode of each of said transistor elements is electrically connected to an associated one of said second signal lines, a second electrode of each of said transistor elements is electrically connected to a first electrode of said light-emitting diode element associated with said transistor element, and said second driving system has a constant-current circuit.

20. A display apparatus according to claim 3, wherein each of said transistor elements is a thin-film transistor, which is operated in a non-saturation region thereof.

21. A display apparatus according to claim 11, wherein each of said transistor elements is a thin-film transistor, which is operated in a non-saturation region thereof.

22. A display apparatus according to claim 12, wherein each of said transistor elements is a thin-film transistor, which is operated in a non-saturation region thereof.

23. A display apparatus according to claim 14, wherein each of said transistor elements is a thin-film transistor, which is operated in a non-saturation region thereof.

24. A display apparatus according to claim 17, wherein each of said transistor elements is a thin-film transistor, which is operated in a non-saturation region thereof.

25. A display apparatus according to claim 19, wherein each of said transistor elements is a thin-film transistor, which is operated in a non-saturation region thereof.

26. A display apparatus according to claim 12, wherein at least one of said first driving system and said second driving system is formed on said first substrate.

27. A display apparatus according to claim 14, wherein at least one of said first driving system and said second driving system is formed on said first substrate.

* * * * *